US011229266B2

(12) United States Patent
Almond et al.

(10) Patent No.: US 11,229,266 B2
(45) Date of Patent: Jan. 25, 2022

(54) TESSELLATING BLISTER PACKAGES FOR CONTACT LENSES

(71) Applicant: CooperVision International Limited, Fareham (GB)

(72) Inventors: Sarah Almond, Southampton (GB); Carlos Ortiz, Pittsford, NY (US); Stephen English, Havant (GB); Gary Hunt, Bristol (GB); Mike Nelson, Bristol (GB); Russell Beard, Bristol (GB); Thomas Harkin, Bristol (GB); Pauline Gavelle, Toulouse (FR)

(73) Assignee: COOPERVISION INTERNATIONAL LIMITED, Fareham (GB)

( * ) Notice: Subject to any disclaimer, the term of this patent is extended or adjusted under 35 U.S.C. 154(b) by 11 days.

(21) Appl. No.: 16/737,942

(22) Filed: Jan. 9, 2020

(65) Prior Publication Data

US 2020/0229563 A1 Jul. 23, 2020

Related U.S. Application Data

(60) Provisional application No. 62/795,309, filed on Jan. 22, 2019.

(51) Int. Cl.

| | |
|---|---|
| ***B65D 21/02*** | (2006.01) |
| ***A45C 11/00*** | (2006.01) |
| ***B65D 75/36*** | (2006.01) |

(52) U.S. Cl.

CPC ..... *A45C 11/005* (2013.01); *B65D 21/0209* (2013.01); *B65D 75/366* (2013.01)

(58) Field of Classification Search

CPC ..... A45C 11/046; A45C 2011/006; A45C 11/005; B65D 75/366; B65D 21/0209

(Continued)

(56) References Cited

U.S. PATENT DOCUMENTS

| | | | |
|---|---|---|---|
| 4,691,820 | A | 9/1987 | Martinez |
| D299,085 | S | 12/1988 | Martinez |

(Continued)

FOREIGN PATENT DOCUMENTS

| | | | |
|---|---|---|---|
| AU | 739045 | B2 | 10/2001 |
| EP | 0734958 | A1 | 10/1996 |

(Continued)

OTHER PUBLICATIONS

International Preliminary Report on Patentability issued in corresponding International Patent Application No. PCT/GB2020/050115 dated Jan. 28, 2021 (41 pages).

(Continued)

*Primary Examiner* — Steven A. Reynolds
(74) *Attorney, Agent, or Firm* — Kilyk & Bowersox, P.L.L.C.

(57) ABSTRACT

A blister package for a contact lens is provided that can be stacked with other blister packages of the same design. One example of the blister package has a body that includes a dome and a handle. A seal is attached to the top surface of the body and has a seal dome that seals a volume between the outer sidewall of the body dome and the inner sidewall of the seal dome. The handle has a through-hole and the through-hole that accommodates the outer sidewall of the seal dome. Another blister package provided has a handle and a bowl and the handle has a through-hole that accommodates the bowl outer surface. Stacks of blister packages are also provided as is secondary packaging for packaging stacks of tessellating blister packages.

15 Claims, 15 Drawing Sheets

(58) Field of Classification Search
USPC ..... 206/5.1
See application file for complete search history.

(56) References Cited

U.S. PATENT DOCUMENTS

| | | | | |
|---|---|---|---|---|
| D305,478 | S | 1/1990 | Lahm et al. | |
| 5,069,494 | A | 12/1991 | Reinson et al. | |
| 5,409,104 | A | 4/1995 | Lovell | |
| 5,456,351 | A | 10/1995 | Johnson | |
| 5,515,964 | A * | 5/1996 | Bauman | A45C 11/005 206/210 |
| 5,609,246 | A | 3/1997 | Borghorst et al. | |
| 5,620,088 | A | 4/1997 | Martin et al. | |
| 5,685,420 | A | 11/1997 | Martin et al. | |
| 5,697,495 | A | 12/1997 | Abrams et al. | |
| 5,704,468 | A | 1/1998 | Lust et al. | |
| 6,044,966 | A | 4/2000 | Haase | |
| 6,260,695 | B1 | 7/2001 | Tasber et al. | |
| 6,398,018 | B1 | 6/2002 | Livesley et al. | |
| 6,471,052 | B2 | 10/2002 | Faxe et al. | |
| 6,474,465 | B1 | 11/2002 | Jux | |
| 6,572,165 | B2 | 6/2003 | Faxe et al. | |
| 6,889,825 | B2 | 5/2005 | Ichikawa et al. | |
| 6,997,344 | B2 | 2/2006 | Brown et al. | |
| 7,086,526 | B2 | 8/2006 | Newman | |
| 7,168,746 | B2 | 1/2007 | Py | |
| 7,426,993 | B2 | 9/2008 | Coldrey et al. | |
| 7,431,152 | B2 | 10/2008 | Marmo | |
| 7,477,366 | B2 | 1/2009 | Clements et al. | |
| 7,699,161 | B2 | 4/2010 | Tokarski et al. | |
| 7,770,732 | B2 | 8/2010 | Stroppolo et al. | |
| 7,784,608 | B2 | 8/2010 | Tokarski et al. | |
| 7,789,266 | B2 | 9/2010 | Biel et al. | |
| 7,816,455 | B2 | 10/2010 | Marmo | |
| 8,061,897 | B2 | 11/2011 | Ichikawa et al. | |
| 8,069,979 | B2 | 12/2011 | Newman et al. | |
| 8,281,920 | B2 | 10/2012 | Tokarski et al. | |
| 8,317,016 | B2 | 11/2012 | Tokarski et al. | |
| 8,459,445 | B2 | 6/2013 | Newman | |
| 8,833,548 | B2 | 9/2014 | Hsieh et al. | |
| 8,955,672 | B2 * | 2/2015 | Newman | B65D 53/00 206/5.1 |
| 9,095,670 | B2 | 8/2015 | Briant et al. | |
| 9,119,450 | B2 | 9/2015 | Lee et al. | |
| 9,173,463 | B2 * | 11/2015 | Clamp | B65D 21/0227 |
| 9,439,487 | B2 | 9/2016 | Barre et al. | |
| 9,655,423 | B1 | 5/2017 | Wang | |
| 9,701,458 | B2 | 7/2017 | Barrows et al. | |
| 9,839,270 | B2 | 12/2017 | Howell et al. | |
| D813,537 | S | 3/2018 | Miura et al. | |
| 10,092,075 | B2 | 10/2018 | Barre et al. | |
| 2006/0054514 | A1 * | 3/2006 | Tokarski | B65D 75/522 206/5.1 |
| 2006/0260957 | A1 | 11/2006 | Hamilton | |
| 2007/0119720 | A1 | 5/2007 | Marmo | |
| 2009/0139879 | A1 | 6/2009 | Tokarski et al. | |
| 2010/0300902 | A1 | 12/2010 | Marmo | |
| 2012/0055817 | A1 | 3/2012 | Newman et al. | |
| 2012/0267262 | A1 | 10/2012 | Wang et al. | |
| 2014/0246337 | A1 | 9/2014 | Newman | |
| 2014/0262845 | A1 | 9/2014 | Newman | |
| 2015/0114851 | A1 * | 4/2015 | English | B65D 75/326 206/5.1 |
| 2015/0129437 | A1 * | 5/2015 | Clamp | A45C 11/005 206/5.1 |
| 2017/0086552 | A1 | 3/2017 | Michalos | |
| 2017/0096272 | A1 | 4/2017 | Coon et al. | |
| 2017/0165901 | A1 | 6/2017 | Fischer et al. | |
| 2018/0125189 | A1 | 5/2018 | Barre et al. | |
| 2019/0008251 | A1 | 1/2019 | Kim | |

FOREIGN PATENT DOCUMENTS

| | | | |
|---|---|---|---|
| GB | 2418418 | A | 3/2006 |
| JP | 2008253746 | A | 10/2008 |
| JP | 2012110592 | A | 6/2012 |
| JP | 5466344 | B1 | 4/2014 |
| JP | 5676760 | B2 | 2/2015 |
| JP | 2016221059 | A | 12/2016 |
| KR | 20090060075 | A | 6/2009 |
| LU | 88593 | A1 | 9/1995 |
| WO | 2009102273 | A1 | 8/2009 |
| WO | 2011112998 | A2 | 9/2011 |
| WO | 2012131786 | A1 | 10/2012 |
| WO | 2012168964 | A1 | 12/2012 |
| WO | 2013098870 | A1 | 7/2013 |
| WO | 2013136361 | A1 | 9/2013 |
| WO | 2013153582 | A1 | 10/2013 |
| WO | 2014195588 | A1 | 12/2014 |
| WO | 2017137738 | A1 | 8/2017 |

OTHER PUBLICATIONS

International Search Report and Written Opinion issued in corresponding International Patent Application No. PCT/GB2020/050115 dated Apr. 3, 2020 (8 pages).
Examination Report issued in corresponding United Kingdom Patent Application No. GB2111863.3 dated Sep. 13, 2021 (5 pages).

* cited by examiner

TESSELLATING BLISTER PACKAGES FOR CONTACT LENSES

This application claims the benefit under 35 U.S.C. § 119(e) of prior U.S. Provisional Patent Application No. 62/795,309, filed Jan. 22, 2019, which is incorporated in its entirety by reference herein.

FIELD OF THE INVENTION

The present invention relates to contact lens packaging and methods, and more specifically, to blister packages for sealed contact lenses containing unworn contact lenses, secondary packaging for packaging a plurality of blister packages, and methods of stacking contact lens packages.

BACKGROUND TO THE INVENTION

Contact lenses, such as hydrogel and silicone hydrogel contact lenses, are frequently packaged in sealed blister packages or blister packs that permit storage of the unworn contact lenses in a sterile environment. For instance, a blister package which is adapted to provide a sterile sealed storage environment for a disposable or single-use hydrophilic contact lens, wherein the lens is immersed in a sterile aqueous solution, for example, such as in an isotonic saline solution, is described in Martinez, U.S. Pat. No. 4,691,820. Additional contact lens packages are disclosed in U.S. Pat. Nos. 4,691,820; 5,054,610; 5,337,888; 5,375,698; 5,409,104; 5,467,868; 5,515,964; 5,609,246; 5,620,088; 5,695,049; 5,697,495; 5,704,468; 5,711,416; 5,722,536; 5,573,108; 5,823,327; 5,704,468; 5,983,608; 6,029,808; 6,044,966; and 6,401,915.

As an example of part of a manufacturing process, a newly manufactured contact lens will be placed in a cavity or bowl of a plastic base member of a contact lens blister package, a contact lens packaging solution will be provided in the blister package cavity, and a foil sealing member will be adhered to the blister package to hermetically seal the contact lens in the packaging solution in the cavity. In other words, a contact lens blister package used in the manufacture of contact lenses contains a base member having a cavity or bowl, an unworn contact lens provided in a packaging solution within the cavity, and a sealing member sealed to the base member to provide an air tight seal around the perimeter of the cavity. The sealed blister package containing the contact lens is then autoclaved to sterilize the contact lens in the packaging solution in the cavity. The blister packs are understood to be primary packaging. Multiple blister packs are then placed in cartons. The cartons are considered secondary packaging. The cartons can be large and cumbersome.

A need exists for a contact lens blister package that enables close packing of a plurality of such blister packages and compact secondary packaging containers to hold them.

SUMMARY OF THE INVENTION

The present invention addresses this need. As discussed herein, new contact lens packaging and methods of manufacturing packaged contact lenses are described. In general, as described herein, a contact lens package is provided. The contact lens package so described includes a plastic base member and a sealing member coupled to the base member to seal a contact lens in a cavity formed between the plastic base member and the sealing member. An unworn contact lens is provided in a contact lens packaging solution in the cavity. This sealed device is referred to herein as a sealed contact lens package or sealed contact lens blister package. The present contact lens package, when opened, presents the contact lens in an orientation for direct placement on a user's fingertip for easy transfer of the lens to the surface of the eye. No digging into a cavity or bowl or pinching of the unworn lens is required to place the lens in a desired orientation for placement onto an eye.

According to an embodiment of the present invention, a blister package for a contact lens is provided. The blister package can comprise a body having a top surface and comprising a handle and a body dome connected to the handle. A seal is attached to the top surface of the body. The seal has a seal top surface and comprises a seal dome having an outer sidewall and an inner sidewall. The seal seals a volume of contact lens solution and a contact lens between the outer sidewall of the body dome and the inner sidewall of the seal dome. The seal dome intersects the seal top surface at an intersection. The seal dome has a diameter or other maximum dimension at the intersection. The handle has a through-hole and the through-hole has a through-hole diameter or other maximum dimension that at least partially accommodates the outer sidewall of the seal dome. The outer sidewall of the seal dome defines a blister package dome.

According to another embodiment of the present invention, a blister package for a contact lens is provided that comprises a body comprising a handle and a bowl connected to the handle. The body has a top surface and a bottom surface. The bowl has a bowl outer surface that intersects with the bottom surface at an intersection. The intersection has a diameter or other maximum dimension. The handle has a through-hole and the through-hole has a through-hole diameter or other maximum dimension that at least partially accommodates the bowl outer surface. A seal is connected to the body and seals the bowl.

Stacks of blister packages according to the present invention are also provided as are methods of stacking blister packages and secondary packaging for stacks of tessellating blister packages.

Other aspects and details of the present invention will be apparent based on the following drawings, detailed description, and claims.

DETAILED DESCRIPTION

Figure 1A:
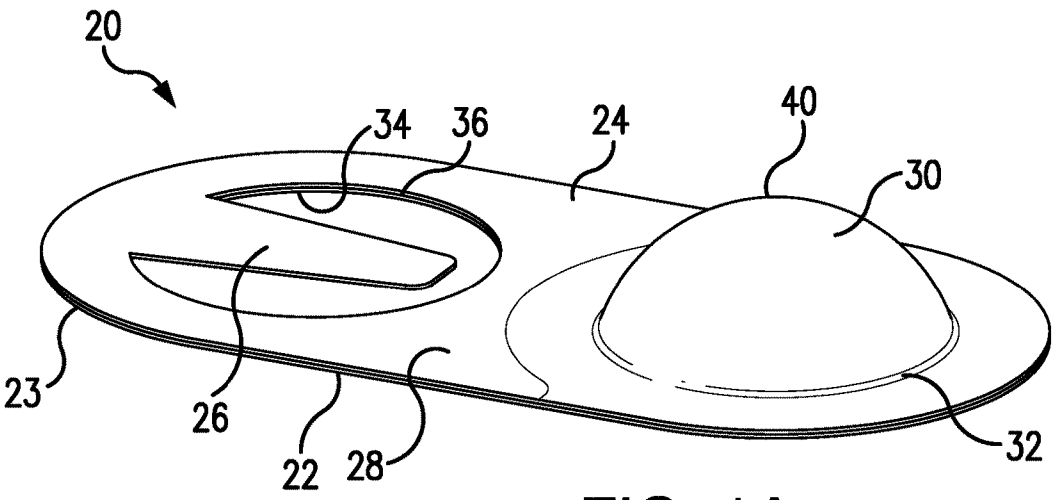
FIG. 1A is a front, right, top perspective view of a blister package according to an embodiment of the present invention.

According to the present invention, a blister package for a contact lens is provided. The blister package comprises a body having a handle and a body dome connected to the handle. The body dome has an outer surface. The outer surface of the body dome provides a seating surface for a contact lens. A seal covers the contact lens on the body dome and seals to the top surface of the body, covering the body dome. The seal comprises a seal dome having an inner sidewall shaped to accommodate the body dome and having an outer sidewall that defines a blister package dome. In the space provided between the outer surface of the body dome and the inner surface of the seal dome, the contact lens can be seated, soaking in contact lens solution. The seal dome inner sidewall can substantially conform to an outer sidewall of the body dome while leaving enough room, when the seal is sealed to the body top surface, to accommodate the contact lens and a volume of contact lens solution.

The blister package has a top surface and the blister package dome rising from the top surface. The base of the outer sidewall of the seal dome, which is the same as the base of the outer sidewall of the blister package dome, intersects the blister package top surface at an intersection. Herein, the outer sidewall of the seal dome will be referred to as a seal dome when the seal is not attached to the body, but the seal dome will be referred to as a blister package dome when the seal is attached to the body, forming an unopened blister package. The intersection has a shape and the shape has a maximum dimension, for example, the shape can be circular and the maximum dimension can be the diameter of the circle. The handle of the blister package has a through-hole, for example, a circular through-hole, and the through-hole has a through-hole diameter or other maximum dimension that is large enough to at least partially accommodate the blister package dome of a second, separate, but substantially identical, contact lens blister package.

A seal can be connected to the body and can seal a volume at least partially defined by the inner sidewall of the seal dome and the outer sidewall of the body dome. The seal is on the top of the blister package such that a volume partly defined by the outer sidewall of the body dome is sealed by the inner sidewall of the dome, for example, along a perimeter at the base of the outer sidewall of the body dome. The through-hole diameter or maximum dimension can be the same size as the diameter or maximum dimension of the blister package dome at the base of the blister package dome. The intersection can have a circular shape and can have a diameter that is the maximum dimension of the dome of the blister package dome at the base of the blister package dome. The through-hole can have a diameter that can be at least as large as the maximum diameter or dimension of the blister package dome. Using circular shapes as an example, the diameter of the through-hole can be at least 50% of the diameter at the intersection, at least 70% of the diameter at the intersection, at least 90% of the diameter at the intersection, or 100% of the diameter at the intersection.

The seal can comprise a tab extending into the through-hole. The tab, or another part of the seal, or both, can be provided with indicia, for example, a prescription, a lot number, and an expiration date of a contact lens packaged and sealed inside the blister package. The blister package can comprise a contact lens enclosed within the volume, and the tab can be marked with indicia pertaining to a prescription of the contact lens. The tab can be used as a pull-tab to facilitate peeling the seal away from the body and opening the bowl formed by inverting the dome.

The body of the blister package can comprise a foil material, or the seal can comprise a foil material, or both components can comprise a foil material. The foil material can comprise a metal foil material, such as aluminum foil. The seal can comprise a two-layer or multi-layer material. The body and the seal can comprise foil material and the dome can be reinforced with a layer of plastic material, a double layer of foil, a plastic reinforcing dome, a combination thereof, or the like. The body can comprise a plastic material and the seal can comprise a foil material.

The present invention also provides a stackable contact lens blister package and an assembly comprising a stack of separate, but identical or substantially identical, contact lens blister packages. For example, each contact lens blister package can be of a type as described herein. By "substantially identical," what is meant is two blister packages that have about the same shape and size, about the same through-hole diameter, and about the same dome diameter at the intersection. An example is a plurality of blister packages made to the same specifications. By "about," what is meant is within 5% of deviation, that is, having dimensions that are no more than 5% larger or 5% smaller than the corresponding dimension of a substantially identical blister package.

A stack of blister packages as described herein, is provided, wherein the through-hole of a first of the blister packages is placed on, and at least partially around, the blister package dome of a second, adjacent, blister package of the blister packages of the stack. The stack can comprise alternating blister packages with the blister package dome of every even-numbered blister package being nestled in the through-hole of every odd-numbered blister package. The alternating arrangement can be referred to as a double stack of tessellating blister packages. In another arrangement, the stack can comprise a triple stack of tessellating blister packages. For a triple stack of tessellating blister packages, the through-hole of a second blister package is arranged on the dome of a first blister package, the through-hole of a third blister package is arranged on the dome of a second blister package but not aligned with the first blister package, and the through-hole of a fourth blister package is arranged on the dome of the third blister package. The fourth blister package of the triple stack is arranged directly above, aligned with, and in the same orientation as the first blister package. The fourth blister package, along with a fifth and a sixth blister package, form the next sequence of three blister packages that repeat the pattern formed by the first, second, and third blister packages.

A secondary container can also be provided, for example, a secondary package, for packaging a stack of contact lens blister packages. For example, a lozenge-shaped container, a pill-shaped container, or an oval-shaped container can be used to hold a double stack of tessellating blister packages, or a container having any other suitable, convenient, and/or compact shape. Each of the blister packages has an outer circumference, the outer circumferences can all have the same profile, the container has an inner circumference having a profile, and the outer circumference profiles of the blister packages can be complementary to the inner circumference profile of the secondary container. A lip or rim can be provided at a top of the container to prevent the blister packages from falling out of the container. A spring can be provided at a bottom wall of the container to gently bias the blister packages upward toward an opening at the lip or rim of the container.

For a triple stack of tessellating blister packages, a triangular container or a container having a triangular footprint can be used to hold the triple stack. Although each of the blister packages can have the same outer circumference, the outer circumference of a triple stack is different, and larger, compared with the outer circumference of a double stack, and the outer circumference of a triple stack is triangular in shape. The triangular container for holding a triple stack can have an inner circumference having a triangular profile, for example, with rounded corners, and the outer circumference profile of the triple stack can be complementary to the inner circumference profile of the secondary container.

Other secondary container designs and configurations can be used, including, for example, collapsible containers, containers with removable lids, containers with hinged lids, containers with push-button release features, containers with combinations of such features, or the like.

For a double stack of tessellating blister packages, each of which comprises a blister package dome, adjacent blister packages of the stack can be attached to one another along adjacent edges. For example, a lateral edge of a first blister package comprising a dome can be connected to a lateral edge of an adjacent, but alternately arranged, second blister package of the stack. Such an arrangement forms a zig-zag configuration, and, although connected along an edge, the blister packages can be easily separated from one another by including score lines, perforations, or the like along the connected edges. In such a zig-zag configuration, it is to be understood that the top and bottom blister packages, each of which comprises a dome, would only be connected to a single adjacent blister package whereas blister packages in the middle of the stack would be connected to both a blister package above in the stack and a blister package below in the stack. Pulling a blister package off of the zig-zag stack can result in positioning the next blister package of the zig-zag stack for removal from the stack. A lip or rim can be provided at a top of the container to prevent the blister packages from falling out of the container. A spring can be provided at a bottom wall of the container to gently bias the blister packages upward toward an opening at the lip or rim.

According to yet another embodiment of the present invention, a blister package for a contact lens is provided that comprises a body having a handle, a bowl connected to the handle, a top surface, and a bottom surface, wherein the handle has a through-hole for accommodating the bowl of an adjacent, identical blister package. A plurality of such blister packages can be stacked, in an alternating fashion, one on top of the other. The bowl can have a bowl outer surface that intersects with the bottom surface at an intersection. The intersection can have a first diameter or first other maximum dimension. The through-hole through the handle can have a diameter or other maximum dimension that is complementary to the first diameter or first other maximum dimension. The through-hole diameter or other maximum dimension can be designed to at least partially accommodate the outer surface of the bowl. A seal is also provided, connected to the body, and sealing the bowl with a contact lens and contact lens solution therein. The through hole can be circular. The through-hole can have a diameter, the intersection can have a diameter, and the diameter of the through-hole can be at least as large as the diameter of the intersection.

The seal can comprise a foil material, for example, a metal foil material such as an aluminum foil material. The seal can comprise a tab extending into the through-hole. The seal can comprise a double layer foil component, for example, comprising a sheet of material folded upon itself and defining a foil seal, a flap, and a fold. The foil seal and the seal flap can intersect at the fold and the foil seal can contact the top surface of the body and seal the bowl. The flap can be configured to be pulled away from the foil seal to form a pull tab, and the pull tab can be configured to be pulled so that the foil seal can be separated from the top surface of the body and the bowl can be opened. The foil seal can be adhered to the top surface of the body and the fold can contact the top surface between the bowl and a distal end of the handle.

The body can comprise a foil material, for example, a metal foil material such as an aluminum foil material. The body can comprise a plastic material, a multi-layer material, or both. The handle can extend from the body top surface, away from the bowl, and turn downwardly to a distal end. The present invention also provides a stack of such blister packages, wherein the bowl of a first of the blister packages is placed in the through-hole of a second, adjacent, blister package of the blister packages. Similar to how the aforementioned blister packages with domes can be held in a secondary container, a stack of blister packages, each of which comprises a bowl, can likewise be held in a secondary container. A secondary container can be provided, for example, a secondary package, for packaging a stack of contact lens blister packages each of which comprises a bowl. For example, a lozenge-shaped container, a pill-shaped container, or an oval-shaped container can be used to hold a double stack of tessellating blister packages, alternately arranged in opposite directions with respect to the blister package above and below. Each of the blister packages has an outer circumference, the outer circumferences can all have the same profile, the container has an inner circumference having a profile, and the outer circumference profiles of the blister packages can be complementary to the inner circumference profile of the secondary container.

As with the blister packages described above, having domes, other secondary container designs or configurations can be used to package a plurality of the blister packages comprising bowls. Such secondary containers can include, for example, collapsible containers, containers with removable lids, containers with hinged lids, containers with push-button release features, containers with combinations of such features, or the like.

The body of the blister package can be formed of a plastic material that can be shaped by injection molding or thermoforming. The plastic material used to make the body can comprise polypropylene, polyethylene, polystyrene, or another thermoplastic material. One or more portions of the body material, particularly in the dome or bowl, can have a vapor transmission of less than 10 grams/100 square inches/24 hours at 70° F. and 50 percent relative humidity.

As stated above, the body of the blister package can comprise a variety of structures, such as a relatively rigid material or a flexible material. The body of the sealed blister package can be a thermoplastic material and the body can include either a dome and a substantially planar body bottom surface surrounding the dome, or a bowl and a substantially planar body top surface surrounding the bowl. The substantially planar body surface provides a sealing surface for sealing the flexible top or flexible bottom, for example, the seal, to the body. The body can be made from a variety of materials. The body can be formed using conventional methods and equipment, such as by injection molding polypropylene resin into body molds in an injection molding machine.

The body can comprise two or more different parts or be made of two or more different materials, for example, a reinforced area defining the body dome or bowl. Reinforcing can be done with a plastic insert, a plastic layer, a double layer foil, or the like.

The flexible top or seal can also be formed from a variety of materials. For example, the flexible top or seal can be a laminated structure comprising a foil and one or more layers of plastic, such as polypropylene and the like. The flexible top or seal can include human readable information, as desired. The flexible top or seal can be coupled to the body surface by contacting the sealing surface of the body with the flexible top or seal and applying heat to fuse the two members together to provide a hermetic or airtight seal for the contact lens and the contact lens solution confined by the dome or bowl. A spacer or other support feature of structure can be integrally formed as part of the body or inserted in the dome or bowl to support the contact lens and to take up space thereby minimizing the amount of contact lens solution needed for packaging.

The perimeter of the body dome, seal dome, or bowl can be contiguous with the circumference of the body dome, seal dome, or bowl, respectively. The perimeter can include a flange region, for example, extending about 5 mm from the opening of the seal dome or bowl to a grip region. In an exemplary embodiment, the overall dimensions of the blister package can be approximately 30 mm wide, about 47 mm long and about 10 mm high. It should be appreciated, however, that the package can have any size and/or shape.

The body dome or bowl holds, in a fluid tight manner, a contact lens and solution. The dome or bowl can be bounded by a seal area that can be part of a flange region. The flexible bottom or flexible top can be attached to the body by heat-sealing in the seal area; however, induction-sealing, sonic welding, or other bonding systems can be used to attach the flexible bottom or flexible top to the body. The total interior volume defined between the body and seal domes, or by the bowl, once sealed, can be about 2.2 ml or less. The volume of the packaging solution in the bowl can be, for example, from about 0.5 ml to about 2.5 ml.

The flexible top or seal can comprise at least two elements, for example, at least two different, separate layers of material. For example, the flexible top or seal can comprise a first member, or first layer, and a second member, or second layer overlaying the first member. The first member can be made of a laminate material that is heat sealed to the seal region of the blister package body. The second member can comprise a foil material, sealed to the rim portion of the body. The second member can comprise at least one, for example two, polymer layers, e.g. polypropylene, coating the foil. The foil can comprise aluminum. The polymer coating material on the heat seal side of the foil can be polypropylene. Examples of useful cover layers are described in U.S. Pat. No. 4,691,820 that is incorporated herein in its entirety by reference. The second member can be sealed to the body along an entire circumference of the body surrounding the inner sidewall of the seal dome or bowl, so as to provide a sanitary or sterile seal, for example, by means of a hermetic seal.

An unworn contact lens is sealed within the domes or bowl of the sealed contact lens blister package and is packaged in a contact lens packaging solution. Any contact lens can be packaged therein. For example, the contact lens can be a hydrogel contact lens or it can be a silicone hydrogel contact lens. Examples of contact lenses that can be provided in the packages include those having the following United States Adopted Names (USANs): methafilcon A, ocufilcon A, ocufilcon B, ocufilcon C, ocufilcon D, omafilcon A, omafilcon B, comfilcon A, enfilcon A, stenfilcon A, etafilcon A, senofilcon A, senofilcon B, senofilcon C, narafilcon A, narafilcon B, balafilcon A, samfilcon A, lotrafilcon A, lotrafilcon B, somofilcon A, riofilcon A, delefilcon A, and the like.

The fluid medium or solution contained by the domes or in the bowl can be any known solution useful for storing contact lenses, including water, saline solutions, or buffered aqueous solutions. The contact lens and solution will preferably fill at least 50 percent, for example, at least 70 percent or at least 80 percent, of the total volume defined by the dome or bowl once sealed by the flexible top or seal.

The contact lens packaging solution is typically a buffered saline solution, such as a phosphate buffered saline solution, or a borate buffered saline solution, that can contain one or more additives, such as surfactants, wetting agents, viscosity agents, and the like.

The blister package can also include a wrap that has one or more panels. The wrap can be dimensioned to accommodate the sealed contact lens package and to also provide an UDI in both human readable form and machine-readable form, in addition to other required regulatory information. As used herein, a UDI is a "Unique Device Identifier". As used herein, a wrap refers to a substrate or article comprising one or more panels coupled to a sealed contact lens package, and an UDI in both human readable form and machine-readable form is provided on at least one of the panels. Such a wrap can be understood to be an "UDI wrap", or it can be understood to be a wrap having an "UDI panel". Thus, the wrap includes human readable information, such as letters, numbers, and images; and the wrap includes machine readable information, such as bar codes and the like. The wrap can be flexible or rigid and does not need to fully enclose or surround the individual sealed contact lens package and can instead be attached to a secondary packaging or container. The wrap can be coupled to the sealed contact lens package so that the wrap and sealed contact lens package do not become separated until a person opens the package to remove the unworn contact lens. For example, the wrap can be adhered to the sealed contact lens package, such as by using an adhesive between a surface of the wrap and a surface of the sealing member, or the wrap can be physically wrapped around the sealed contact lens package to mechanically enclose the sealed contact lens package within the wrap. Thus, the wrap cannot be inadvertently dislodged or separated from the sealed contact lens blister package.

Examples of blister package materials, methods of making blister package bodies, flexible tops, seals, methods of making flexible tops, methods of sealing flexible tops to bodies, as well as other helpful components, materials, methods, and systems are described, for example, in U.S. Pat. Nos. 6,398,018, 7,426,993 B2, and 7,477,366 B2, in U.S. Patent Application Publications Nos. US 2012/0061260 A1, and US 2017/0096272 A1, and in WO 2013/160667, each of which is incorporated herein in its entirety by reference.

Figure 1B:
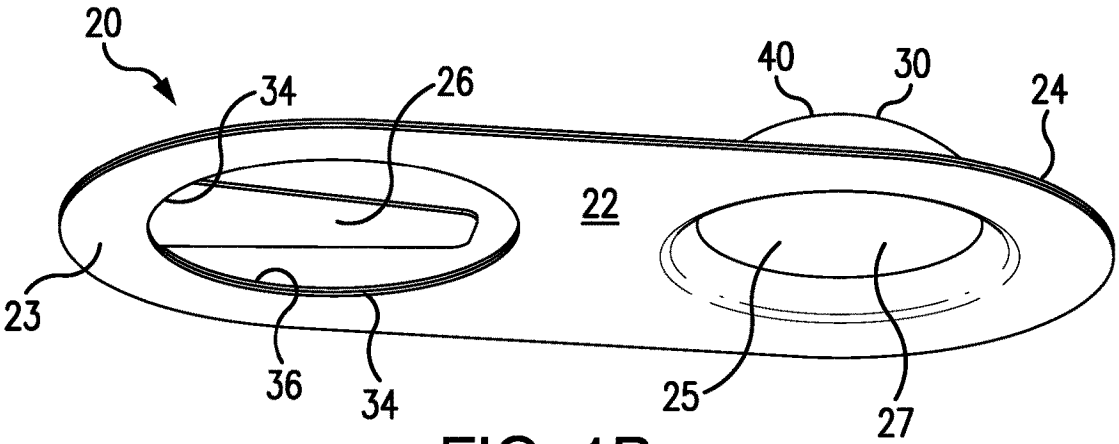
FIG. 1B is a front, left, bottom perspective view of the blister package shown in FIG. 1A.
Figure 1C:
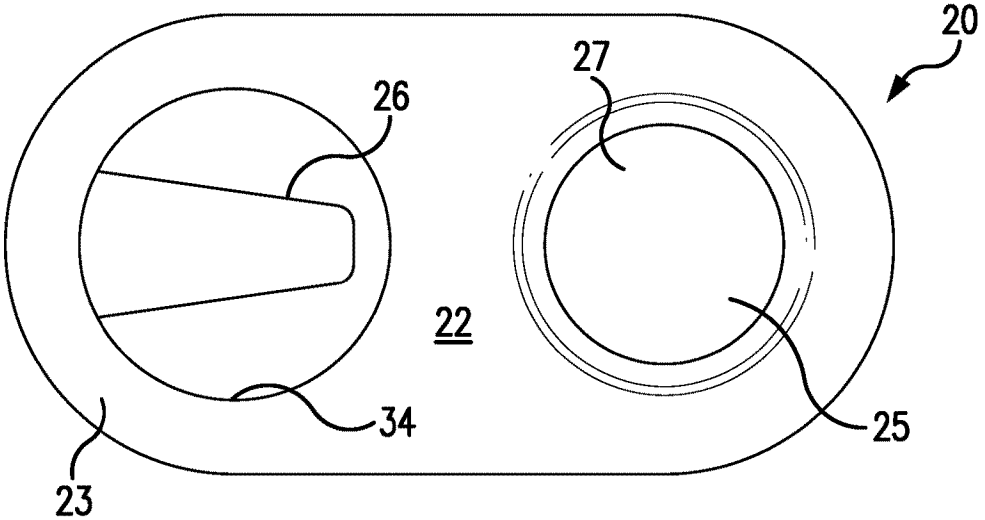
FIG. 1C is a bottom view of the blister package shown in FIGS. 1A and 1B.
Figure 1D:
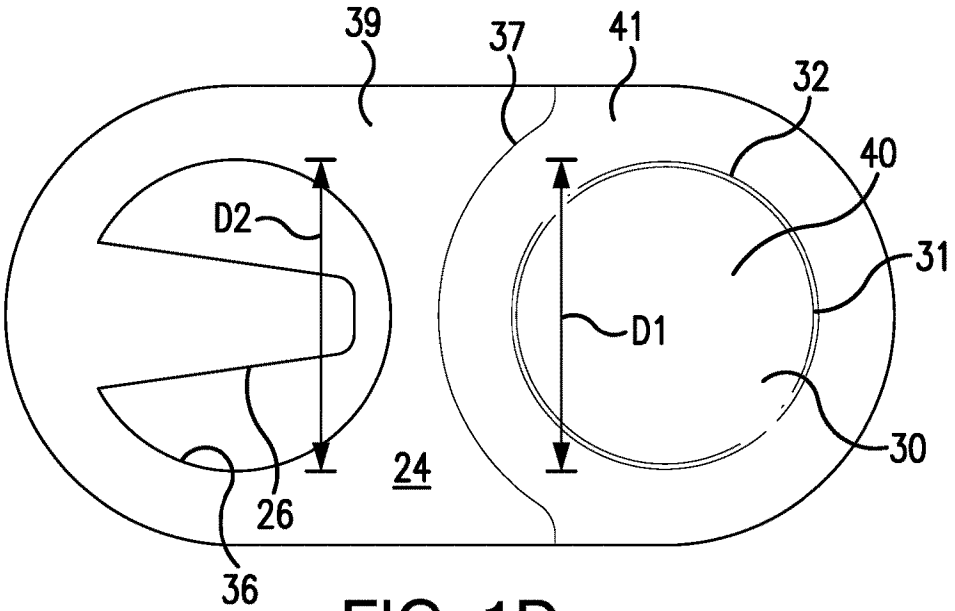
FIG. 1D is a top view of the blister package shown in FIGS. 1A-1C.
Figure 1E:
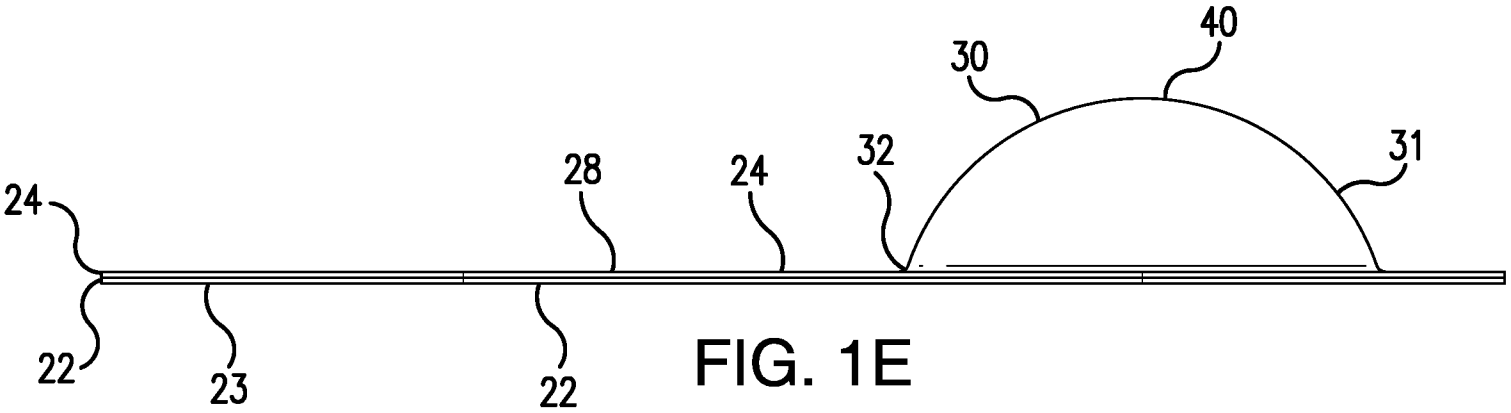
FIG. 1E is a side view of the blister package shown in FIGS. 1A-1D.
Figure 1F:
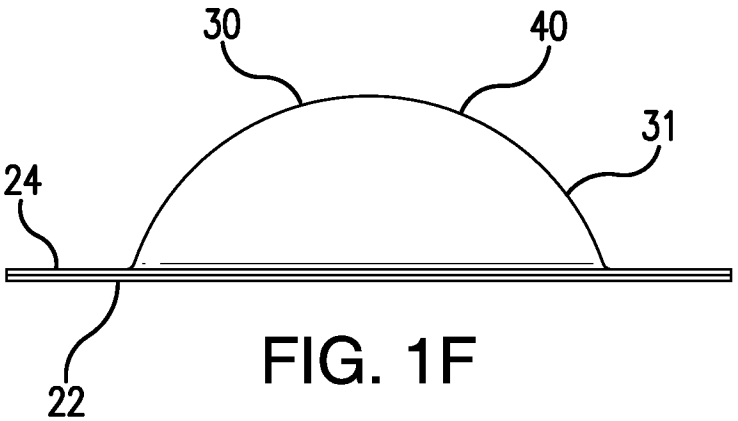
FIG. 1F is a front, end view of the blister package shown in FIGS. 1A-1E.

With reference to the drawings, FIGS. 1A-1F are different views of a blister package 20 for a contact lens, according to an embodiment of the present invention. FIG. 1A is a front, right, top perspective view of blister package 20. FIG. 1B is a front, left, bottom perspective view of blister package 20. FIG. 1C is a bottom view of blister package 20. FIG. 1D is a top view of blister package 20. FIG. 1E is a side view of blister package 20. FIG. 1F is a front, end view of blister package 20.

Blister package 20 comprises a two-layer structure including a bottom layer body 22 and a top layer seal 24. Body 22 defines a handle 23 and, as shown in FIG. 1B, a body dome 25 having an inner sidewall 27. Inner sidewall 27 can be stepped. A top surface of body 22 is attached or sealed to a bottom surface of seal 24. Seal 24 defines a seal dome 30 having an outer sidewall 31. Seal dome 30 rises from a top surface 28 of seal 24. Top surface 28 is also the top surface of blister package 20 in the unopened state of blister package 20 shown in FIGS. 1A-1F. Seal dome 30 intersects top surface 28 at an intersection 32. Seal dome 30 has a diameter D1 at intersection 32, as shown in the top view of FIG. 1D. Seal dome 30 has an inner sidewall (not shown) that defines a sealed volume with an outer sidewall of body dome 25. FIG. 1D also shows a line of delineation 37 at which the material used to make seal 24 can be divided into a first material or section 39 and a second material or section 41. Material 39 can be used for the entirety of seal 24 or for just the portion on the left side of line 37. Material 41 can be separated from material 39 or can constitute an additional layer on top of or below material 39, for example, if material 39 extends over the entirety of seal 24 material 41 can be in addition to material 39. Material 41 can comprise a reinforcing plastic material.

Handle 23 has a through-hole 34 and seal 24 has a through-hole 36 aligned with through-hole 34. Through-holes 34 and 36 have the same through-hole diameter D2 or other maximum dimension for at least partially accommodating seal dome 30. Seal dome 30 also defines the outer sidewall of a blister package 40 in the unopened state of blister package 20 shown in FIGS. 1A-1F. Diameter D2 can be at least as large as diameter D1. Diameter D1 can be at least as large as diameter D2.

Seal dome 30 defines and seals a volume between the inner sidewall thereof and the outer sidewall of body dome 25. Seal dome 30 has a diameter or other maximum dimension at intersection 31, and the through-hole 34 has a through-hole diameter or other maximum dimension for at least partially accommodating the outer sidewall of seal dome 30 and thus blister package dome 40. As can be seen, blister package dome 40 has a circular shape at intersection 31. Through-holes 34 and 36 also have a circular shape. The diameters of the through-holes are large enough to at least partially accommodate blister package dome 40.

As can be seen in FIGS. 1A-1D, seal 24 comprises a tab 26 extending into the double-layer through-hole made by through-holes 34 and 36. Tab 26 can be marked with indicia pertaining to a prescription of a contact lens held within blister package 20. Body 22 and seal 24 can each, independently, comprise a foil material, a plastic material, or both. Seal dome 30 can be reinforced with a layer of plastic material or with a plastic insert. Both body 22 and seal 24 can comprise a plastic material.

Due to the dome and through-hole design, blister package 20 and a plurality of blister packages identical to blister package 20 can be stacked together and form a stack of tessellating blister packages. Inner sidewall 27 of body dome 25 can be of sufficient width and depth to receive a blister package dome of an adjacent, or spaced apart, underlying blister package. By identical, it is to be understood that contact lenses of two different prescriptions can be alternatively stacked yet still be considered identical blister packages. When stacking, a through-hole 34 of a first of the blister packages is placed on, and at least partially around, a blister package dome 40 of a second, adjacent, blister package of the blister packages of the stack. Each of the blister packages has an outer circumference, the outer circumferences can all have the same profile, and the stack of blister packages can be packaged in a container having an inner circumference profile that holds, and, for example, is complementary to, and the outer circumference profiles of the blister packages. Adjacent blister packages of the stack can be connected to one another along edges thereof such that the stack can comprise a zig-zag configuration.

Figure 2:
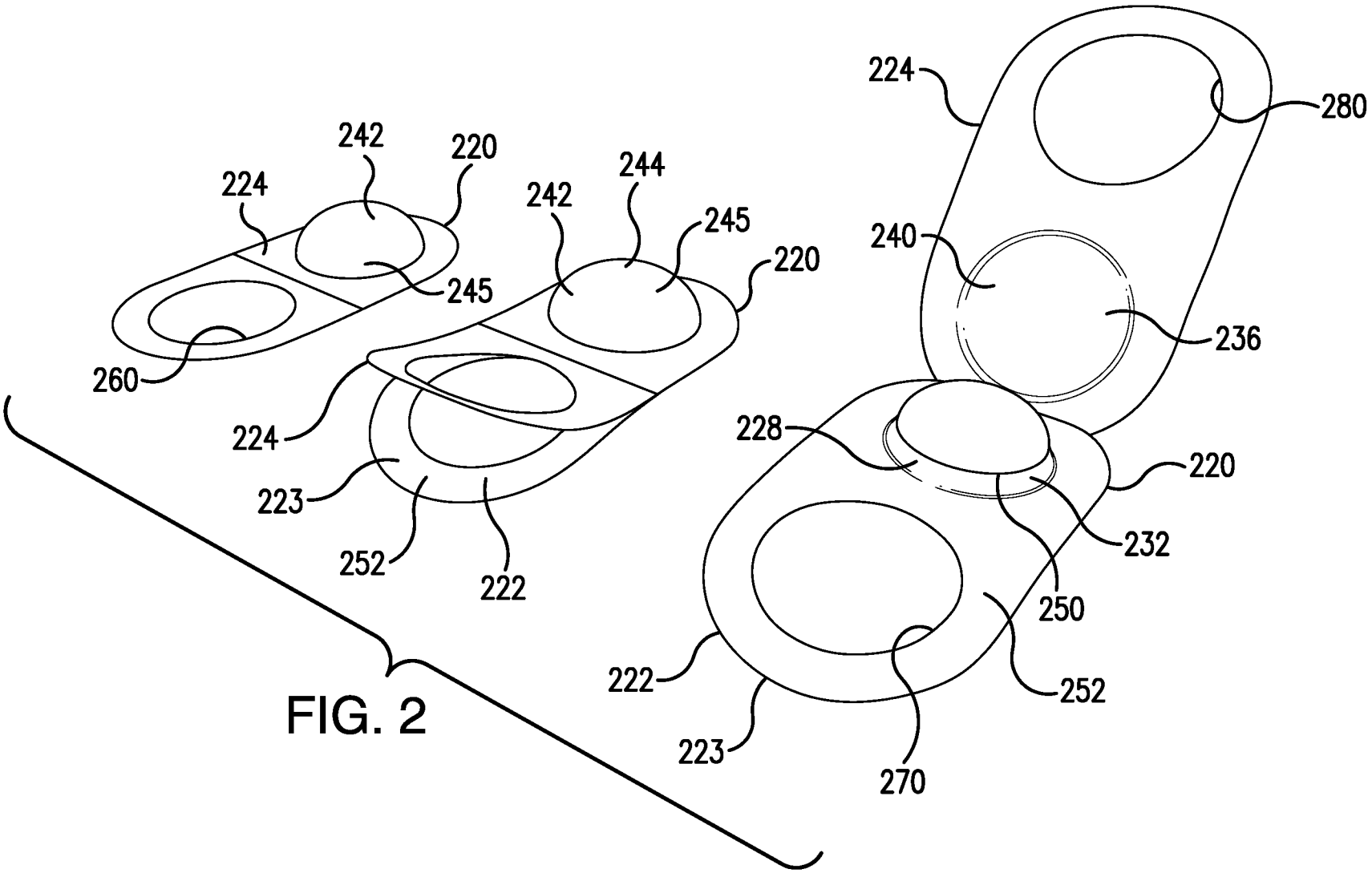
FIG. 2 shows a series of steps involved with opening a blister package according to an embodiment of the present invention.

FIG. 2 illustrates the sequential steps involved with opening a blister pack 220 according to an exemplary embodiment of the present invention. FIG. 2 shows the same single blister pack 220 at three different points in time during an opening procedure. To the far left is a new, unopened, and unpeeled blister package 220. Blister package 220 comprises a body 222 and a seal 224 sealing a contact lens 250 between an outer sidewall 228 of a body dome 232 and an inner sidewall 236 of a seal dome 240, which features can be seen in the last state of the sequence. An outer surface 242 of seal dome 240 is also the outer surface 244 of the assembled blister package dome 245. Body 222 defines body dome 232 and a handle 223. In the middle state shown, seal 224 has been slightly lifted off of a portion of a top surface 252 of body 222. Once seal 224 is peeled back, as shown to the far right, contact lens 250 can be contacted with a fingertip and applied on an eye.

As also shown in FIG. 2, blister package 220 has a two-layer through-hole 260 constructed of a body through-hole 270 and a seal through-hole 280 that are aligned with and the same size as one another. Two-layer through-hole 260 is large enough to accommodate blister package dome 245 such that blister package 220 can be stacked in an alternating fashion with one or more identical blister packages as shown in FIG. 3.

Figure 3:
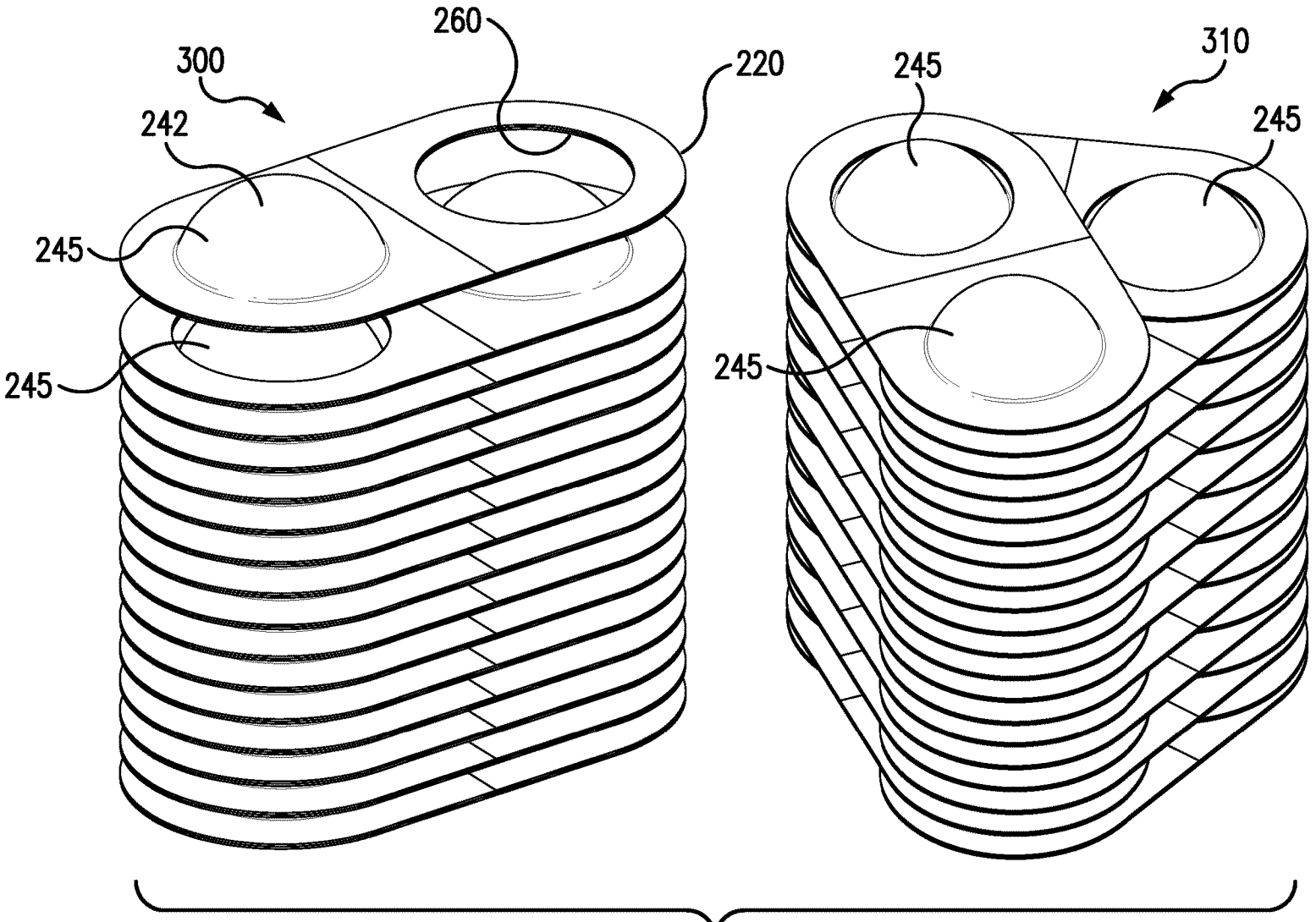
FIG. 3 illustrates a double stack and a triple stack of blister packages of the type shown in FIG. 2 wherein blister package domes of underlying blister packages are accommodated by and protrude through the blister package through-holes of the overlying blister packages.

With regard to FIG. 3, a plurality of blister packages 220 as shown in FIG. 2 are stacked together, in an alternating arrangement, to form a double stack 300 and a triple stack 310. In each stack, the blister package dome 245 of an underlying blister package 220 is accommodated by and protrudes through blister package through-hole 260 of the overlying blister package. As such, a stack can take up very little space, providing a compact design for packaging and storing a plurality of blister packages.

Figure 4:
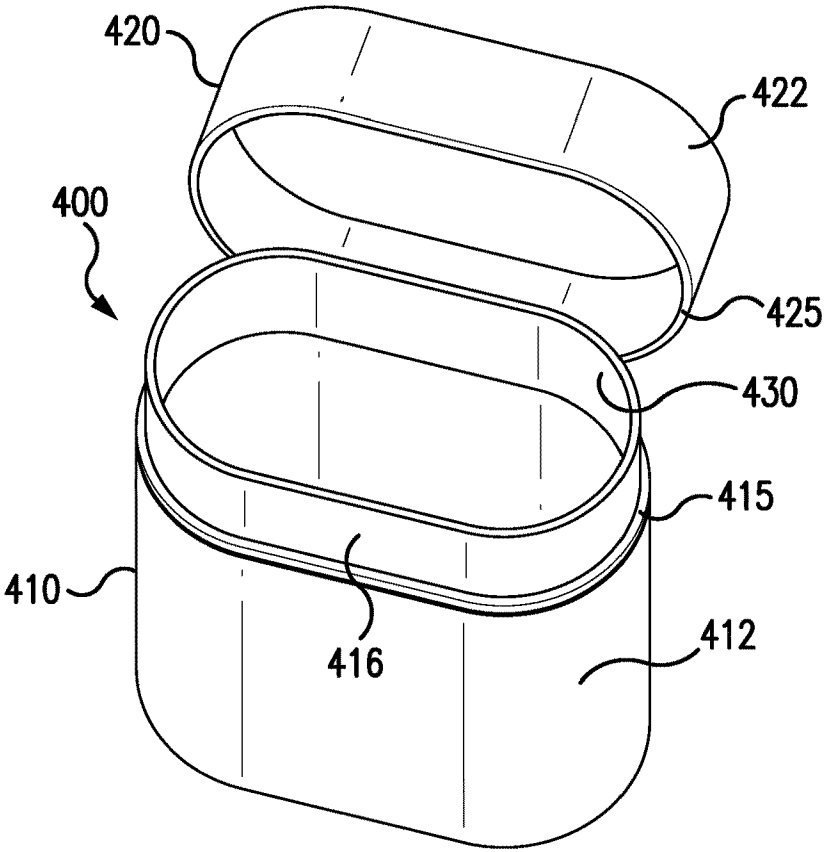
FIG. 4 is a front, right, top perspective view of an open container for storing and protecting a double stack of blister packages such as the double stack shown in FIG. 3, according to yet another embodiment of the present invention.

FIG. 4 is a front, right, top perspective view of an open container 400 for storing and protecting a double stack of blister packages such as double stack 300 shown in FIG. 3. container 400 includes a container body 410 and a removable lid 420. An inner circumference 430 of container body 410 can be sized and shaped to be slightly larger than an outer circumference of the double stack of blister packages such that the double stack can fit inside container 400. Container body 410 has a shoulder 415 defining a top portion 416 of smaller outside circumference compared with the outer circumference of the container body proper. A bottom edge 425 of lid 420 sits on shoulder 415 when lid 420 is placed on and closes container body 410 and the outside surface 412 of container body 410 and the outer surface 422 of lid 420 are of the same outer cross-sectional shape. When container 400 is closed, outer surface 412 and outer surface 422 are flush with and continuous with one another.

Figure 5:
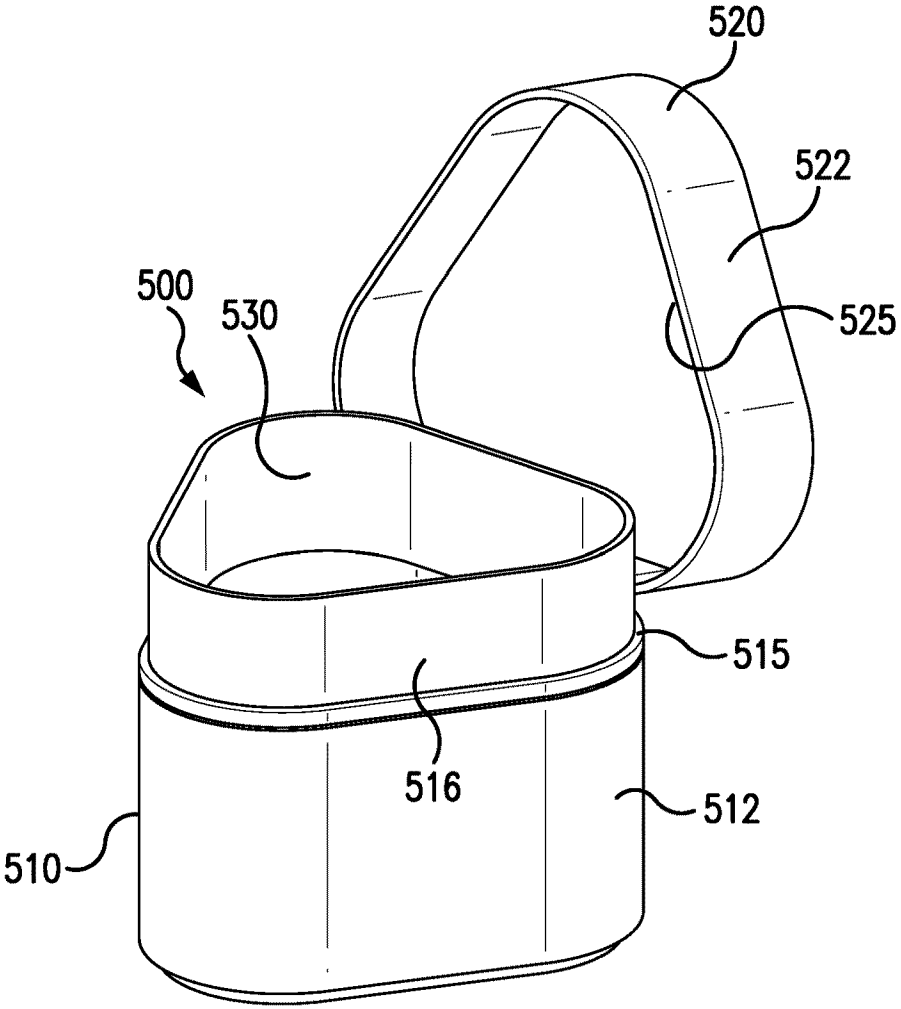
FIG. 5 is a front, right, top perspective view of an open container for storing and protecting a triple stack of blister packages such as the triple stack shown in FIG. 3, according to yet another embodiment of the present invention.

FIG. 5 is a front, right, top perspective view of an open container 500 for storing and protecting a triple stack of blister packages such as triple stack 310 shown in FIG. 3. Container 500 includes a container body 510 and a removable lid 520. An inner circumference 530 of container body 510 can be sized and shaped to be slightly larger than an outer circumference of the triple stack of blister packages such that the triple stack can fit inside container 500. Container body 510 has a shoulder 515 defining a top portion 516 of smaller outside circumference compared with the outer circumference of the container body proper. A bottom edge 525 of lid 520 sits on shoulder 515 when lid 520 is placed on and closes container body 510 and the outside surface 512 of container body 510 and the outer surface 522 of lid 520 are of the same outer cross-sectional shape. When container 500 is closed, outer surface 512 and outer surface 522 are flush with and continuous with one another.

Figure 6:
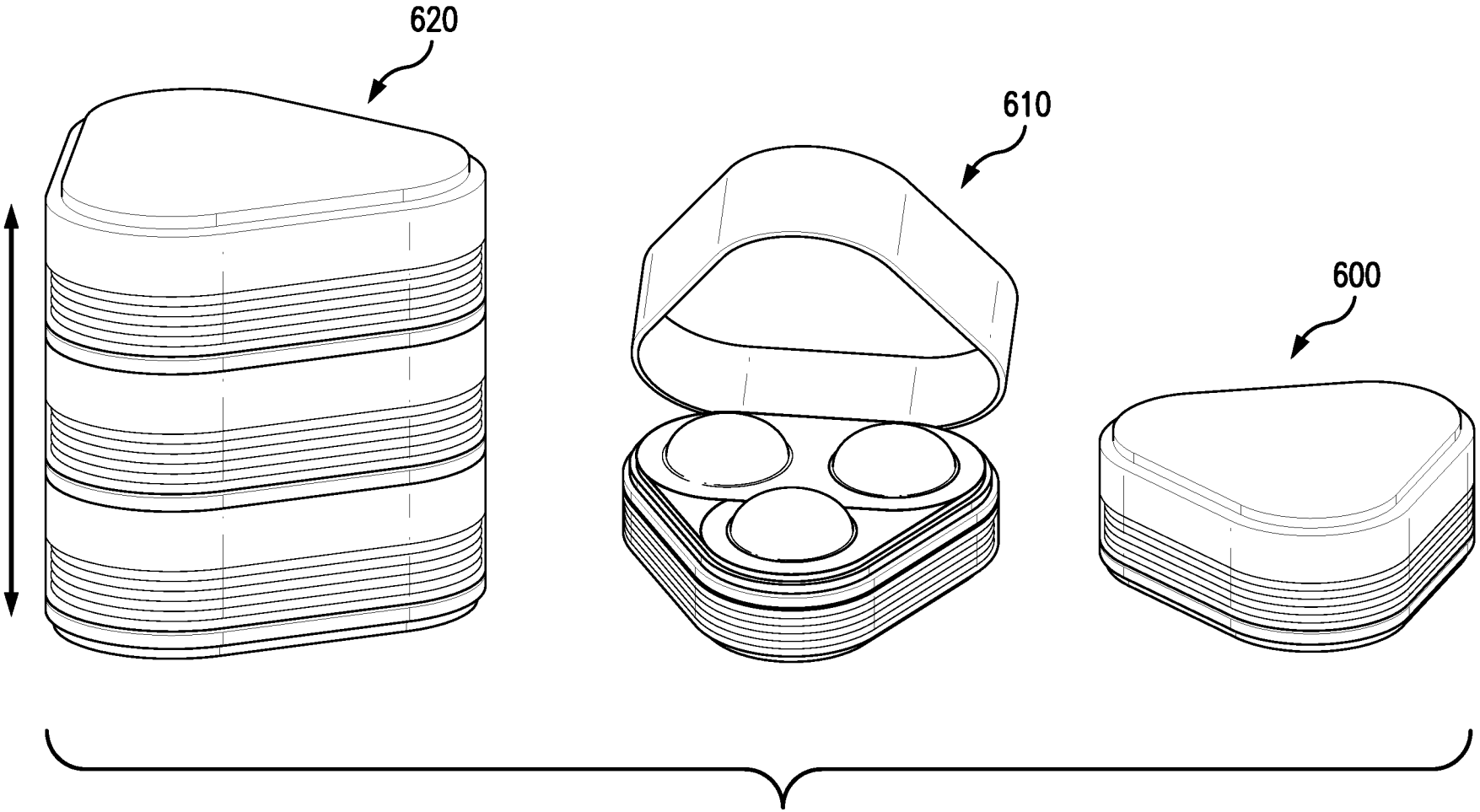
FIG. 6 shows another secondary container for packaging a plurality of blister packages of the type shown in FIG. 2, in a triple stack arrangement, according to yet another embodiment of the present invention.

FIG. 6 shows another secondary container for packaging a plurality of blister packages of the type shown in FIG. 2, in a triple stack arrangement. A container 600 shares similar design features to those shown in FIG. 5 but has a shorter overall height. Arrangement 610 shows container 600 with its lid partially removed. Stack 620 shows three different containers 600 shown stacked one on top of the other. Shoulders, rims, or other alignment features can be included at the top and bottom of each secondary container to enable stable stacking.

Figure 7:
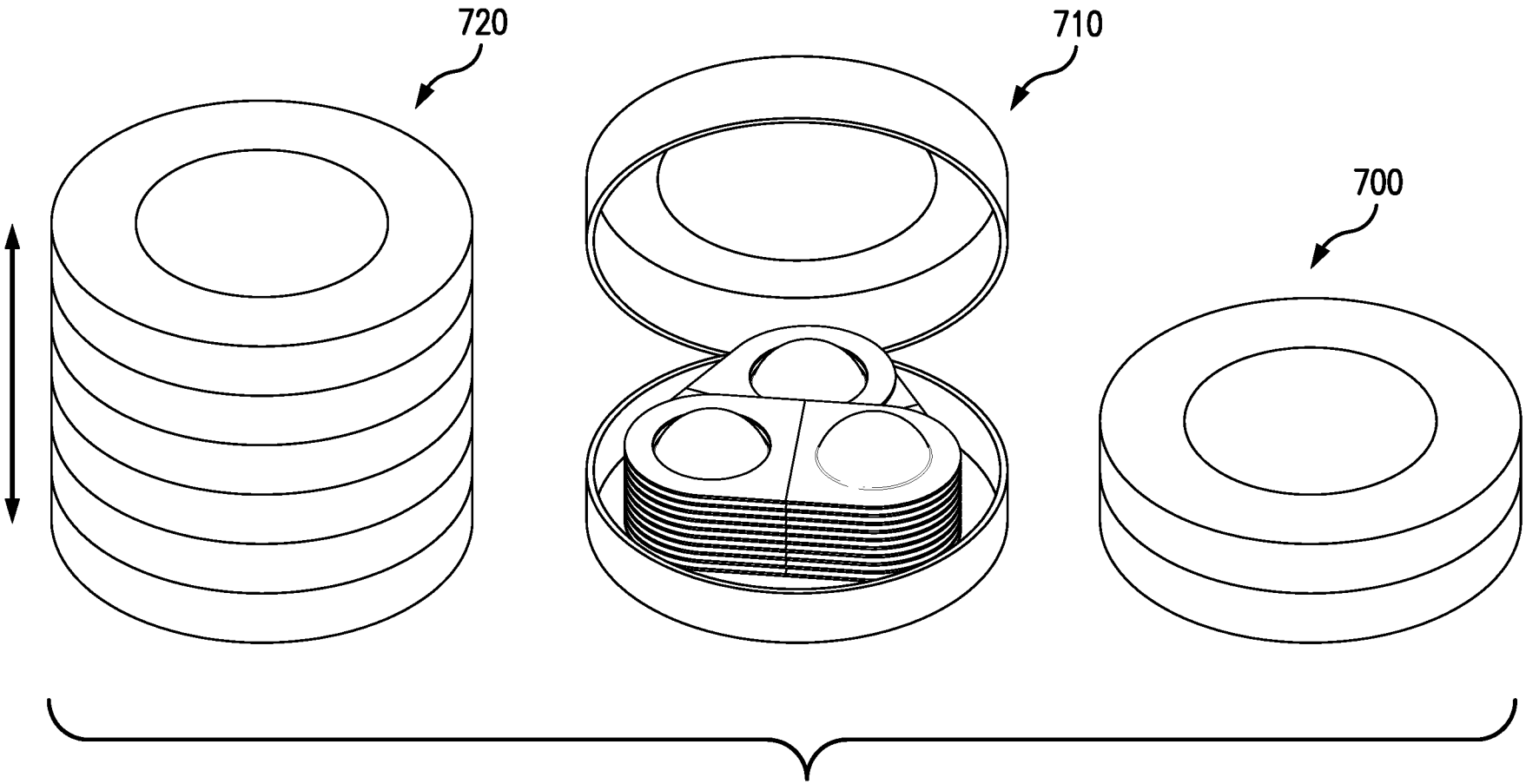
FIG. 7 shows yet another secondary container for packaging a plurality of blister packages of the type shown in FIG. 2, in a triple stack arrangement, according to yet another embodiment of the present invention.

FIG. 7 shows yet another secondary container for packaging a plurality of blister packages of the type shown in FIG. 2, in a triple stack arrangement. A container 700 has a rounded outer profile similar to a compact case for cosmetics. Arrangement 710 shows container 700 with its lid partially removed. Stack 720 shows three different containers 700 shown stacked one on top of the other. Shoulders, rims, or other alignment features can be included at the top and bottom of each secondary container to enable stable stacking.

Figure 8:
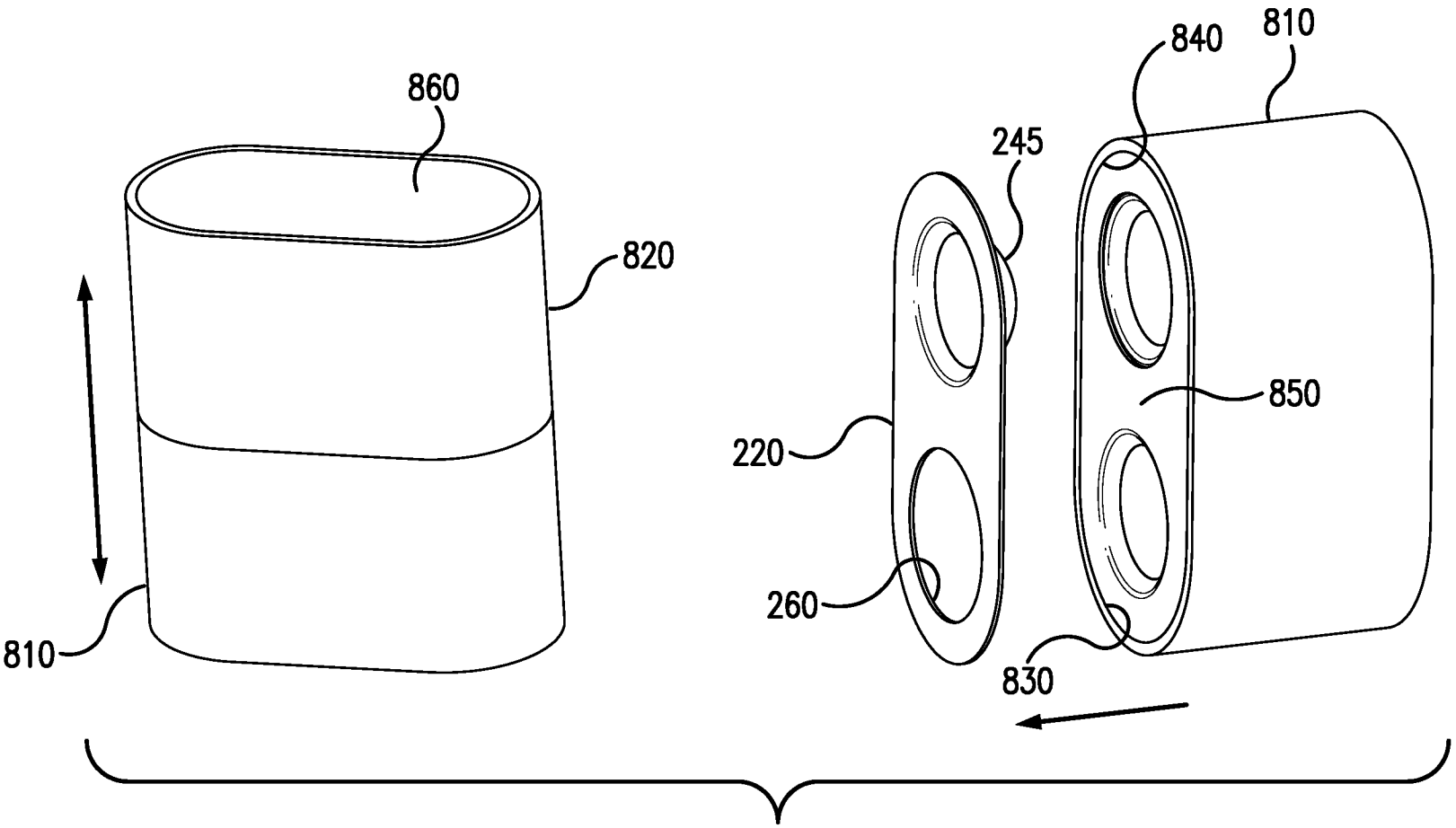
FIG. 8 shows yet another secondary container for packaging a plurality of blister packages of the type shown in FIG. 2, in a double stack arrangement, according to yet another embodiment of the present invention.

FIG. 8 shows yet another secondary container 810 for packaging a plurality of blister packages 220 of the type shown in FIG. 2, in a double stack arrangement. Container 810 can be stacked with another container 820 of the same design as shown to left in FIG. 8. An inner circumference of container body 810 can be sized and shaped to be slightly larger than an outer circumference of a double stack 850 of blister packages such that double stack 850 can fit inside container 810. A lip 830 can be provided at an opening 840 of container 810 to secure double stack 850 of blister packages in container 810 and provide a bit of resistance against double stack 850 to prevent double stack 850 or any blister packages thereof from falling out of contain 810. Blister package through-hole 260 of the outermost blister package of double stack 850 can be pulled by a fingertip to dislodge the outermost blister package from double stack 850 and container 810. The blister packages domes 245 of the blister packages of double stack point 850 into contain 810 rather than being exposed at opening 840. A spring or other biasing feature can be provided at the bottom of container 810 to facilitate positioning of the outermost blister package of double stack 850 at opening 840. A removable end cap 860 can close one or both ends of containers 810 and 820 and can include indicia pertaining to the prescription, lot number, expiration date, and the like, of the blister packages contained within the container.

Figure 9:
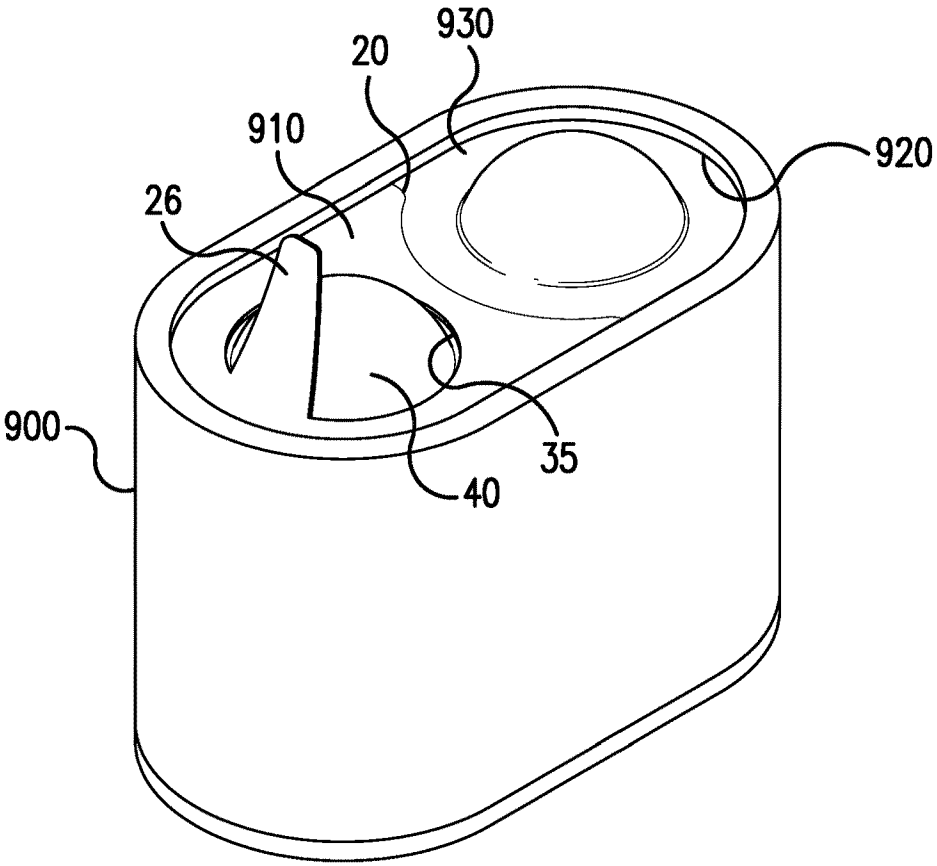
FIG. 9 shows a secondary container for packaging a plurality of blister packages of the type shown in FIGS. 1A-1F, in a double stack arrangement, according to yet another embodiment of the present invention.

FIG. 9 shows yet another secondary container 900 for packaging a plurality of blister packages 20 of the type shown in FIGS. 1A-1F, in a double stack arrangement. Container 900 can be stacked with other containers of the same design. An inner circumference of container 900 can be sized and shaped to be slightly larger than an outer circumference of a double stack 910 of blister packages 20 such that double stack 910 can fit inside container 900. A lip 920 can be provided at an opening 930 of container 900 to secure double stack 910 in container 900 and provide a bit of resistance against double stack 910 to prevent double stack 910 or any blister packages 20 thereof from falling out of contain 900. Blister package through-hole 35 of the outermost blister package of double stack 910 includes a tab 26 as can also be seen in FIGS. 1A-1D. Blister package dome 40 of the blister package second-from-the-top protrudes through through-hole 35 forcing tab 26 of the top blister package of double stack 910 to protrude upwardly where it can be easily grabbed by a user, facilitating the withdrawal of top blister package 20 from container 900. Lip 920 can provide some degree of resistance against withdrawal of blister package 20. Once removed, the blister package that had been second-from-the-top will then be exposed and its through-hole tab will protrude from its respective blister package through-hole. A spring or other biasing feature can be provided at the bottom of container 900 to facilitate positioning of the outermost blister package of double stack 910 at opening 930. A removable end cap (not shown) can close one or both ends of container 900 and can include indicia pertaining to the prescription, lot number, expiration date, and the like, of the blister packages of double stack 910.

Figure 10:
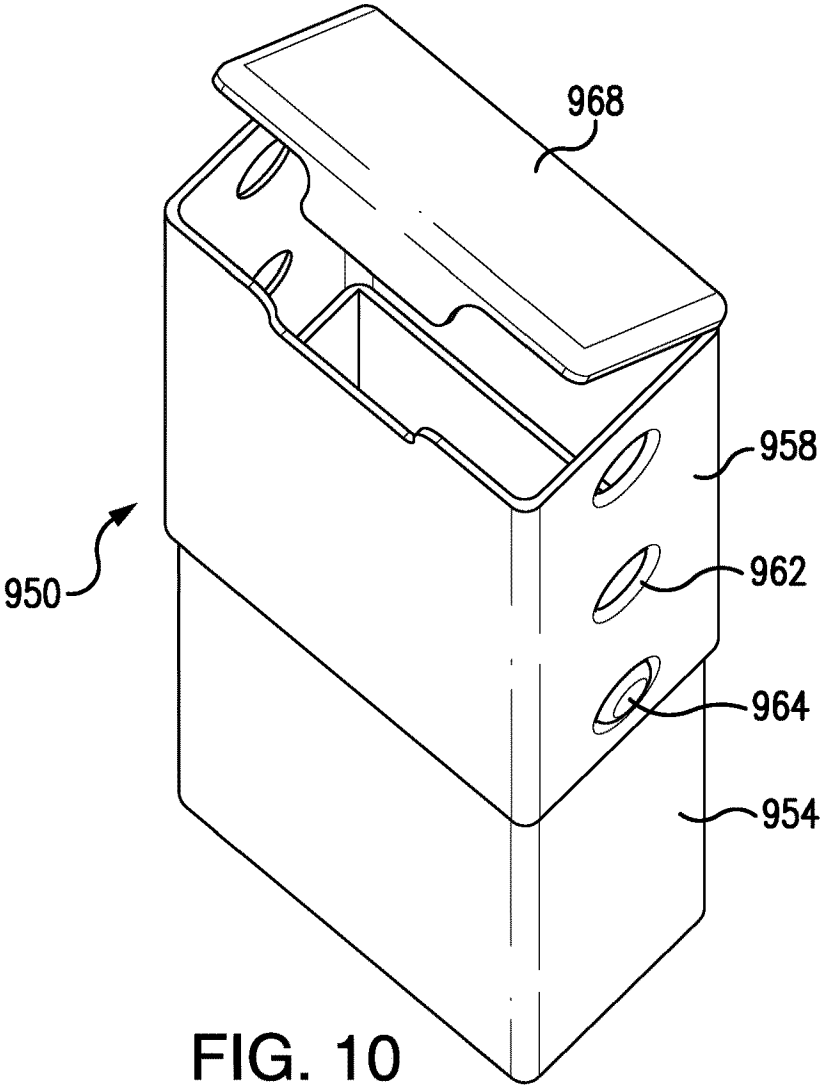
FIG. 10 is a front, right, top perspective view of a collapsible container that can be used to store and protect a stack of blister packages, according to yet another embodiment of the present invention.

FIG. 10 is a front, right, top perspective view of a collapsible container 950 that can be used to store and protect a double stack of tessellating blister packages, according to yet another embodiment of the present invention. A container 950 includes a base 954 and a sliding container body 958 that can be positioned at different heights to adjust the overall height of container 950. A spring-biased captured ball 964 and an identical one on the other side of container 950 can fit in any one of three through-holes 962 to thereby adjust the position of sliding container body 958 with respect to base 954. A stack of contact lens can be contained in container 950 and as the stack is used up and thus shortened container 950 can likewise be shortened. As a result, the top blister package of the stack can be made more easily accessible and digging deep into container 950 to retrieve a blister package can be avoided. A hinged lid 968 is provided, for example, with a latch, to prevent the stack from falling out of container 950. The stack can comprise a double stack of blister packages, for example, a double stack of tessellating blister packages in accordance with an embodiment of the present invention.

Figure 12:
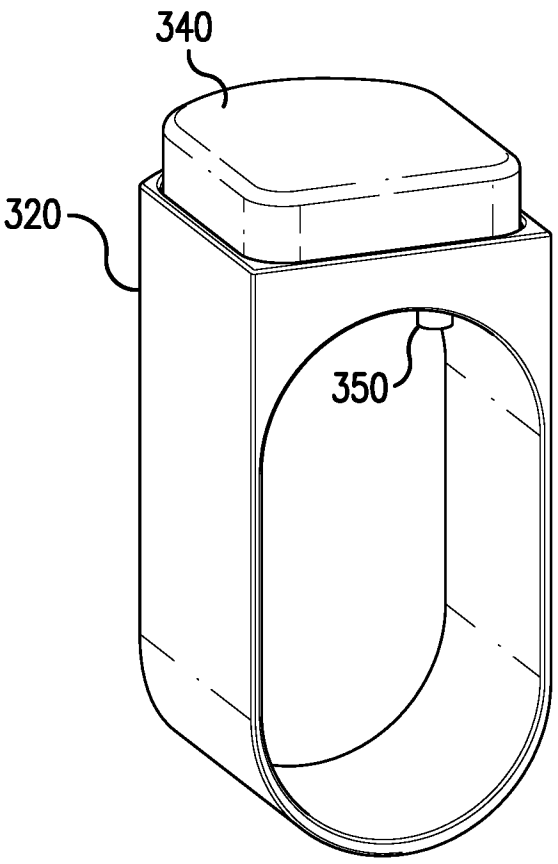
FIG. 12 is a front, left, top perspective view of the container shown in FIG. 11, but empty, without the zig-zag double stack of blister packages contained therein.
Figure 11:
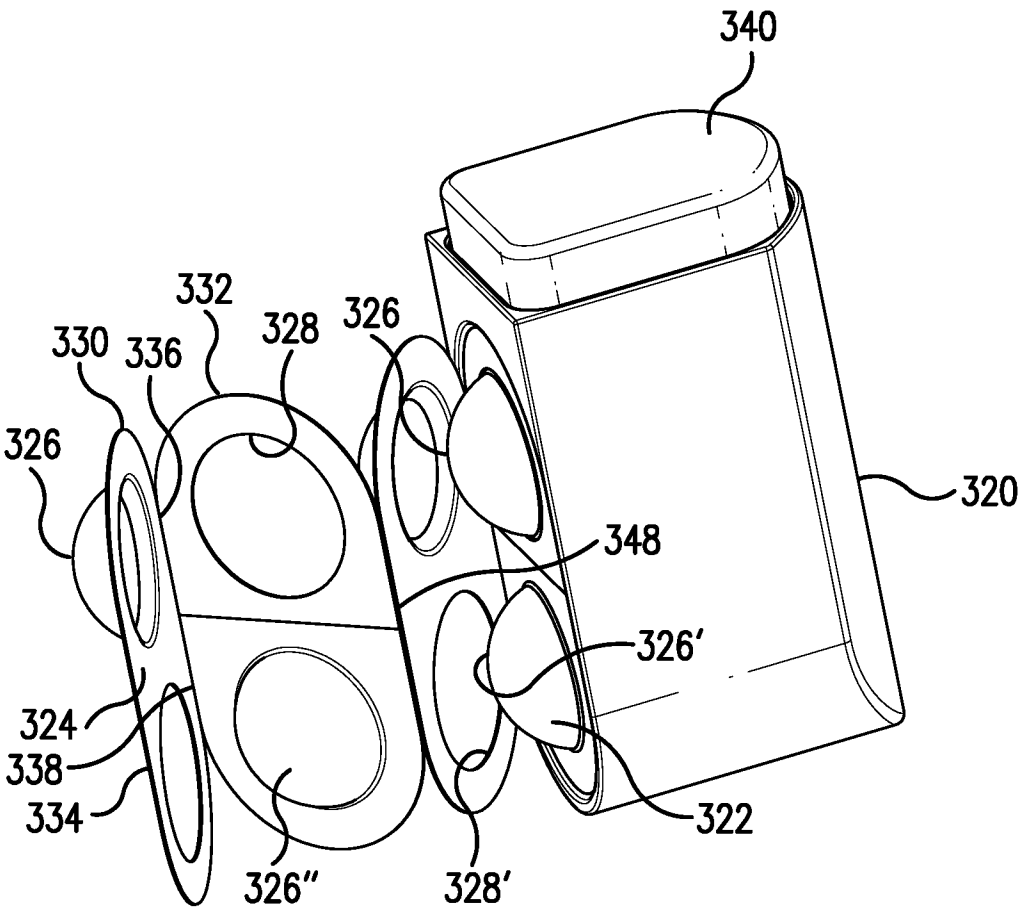
FIG. 11 is a front, right, top perspective view of a container and zig-zag double stack of blister packages partially held within the container, according to yet another embodiment of the present invention.

FIG. 11 is a front, right, top perspective view of a container 320 and a zig-zag double stack 322 of blister packages 324 partially held within container 320. FIG. 12 is a front, left, top perspective view of container 320 but empty, without the zig-zag double stack of blister packages contained therein. As can be seen in FIG. 11, zig-zag double stack 322 of blister packages 324 fits within the interior of container 320, although three blister packages 324 have been removed from container 320 to show the details of zig-zag double stack 322. Each blister package 324 comprises a blister package dome 326 and a blister package through-hole 328 and can be of the type shown in FIGS. 2 and 3. The outermost blister package 330 of zig-zag double stack 322 includes a lateral edge 334 that is not connected to any other blister package. The opposite lateral edge 336, of outermost blister package 330, however, is connected to a lateral edge 338 of the second blister package 332 of zig-zag double stack 322. Unlike outermost blister package 330, second blister package 332 has both of its lateral edges, 338 and 348, connected to adjacent blister packages. Once outermost blister package 330 is peeled away from blister package 332 and zig-zag double stack 322, second blister package 332 will then become the new outermost blister package. FIG. 12 shows a catch 350 that can be actuated with a push-button 340 to release the outermost blister package of a retained zig-zag double stack, from the interior of container 320.

As can be seen in FIG. 11, each blister package dome 326 protrudes through the through-hole of the immediately overlying blister package and extends into the inner cavity formed by the inside surface of the blister package dome from the blister package two-away and overlying. Thus, for example, when packed in container 320 as opposed to being extended as shown, dome 326' would protrude through through-hole 328 and into the inside surface (not shown) of blister package dome 326".

Figure 13A:
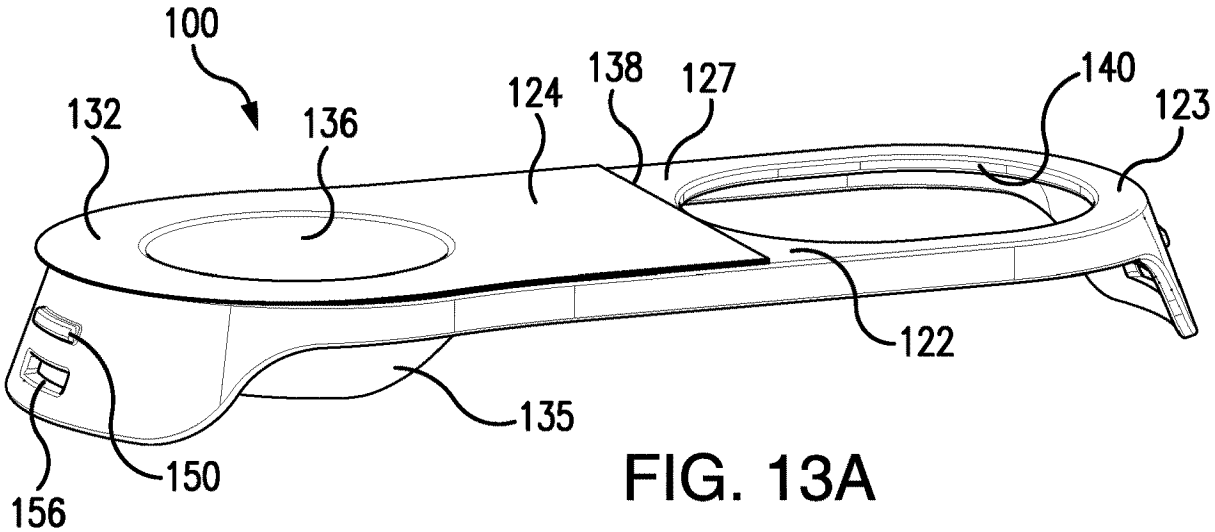
FIG. 13A is a front, right, top perspective view of a blister package according to yet another embodiment of the present invention.
Figure 13B:
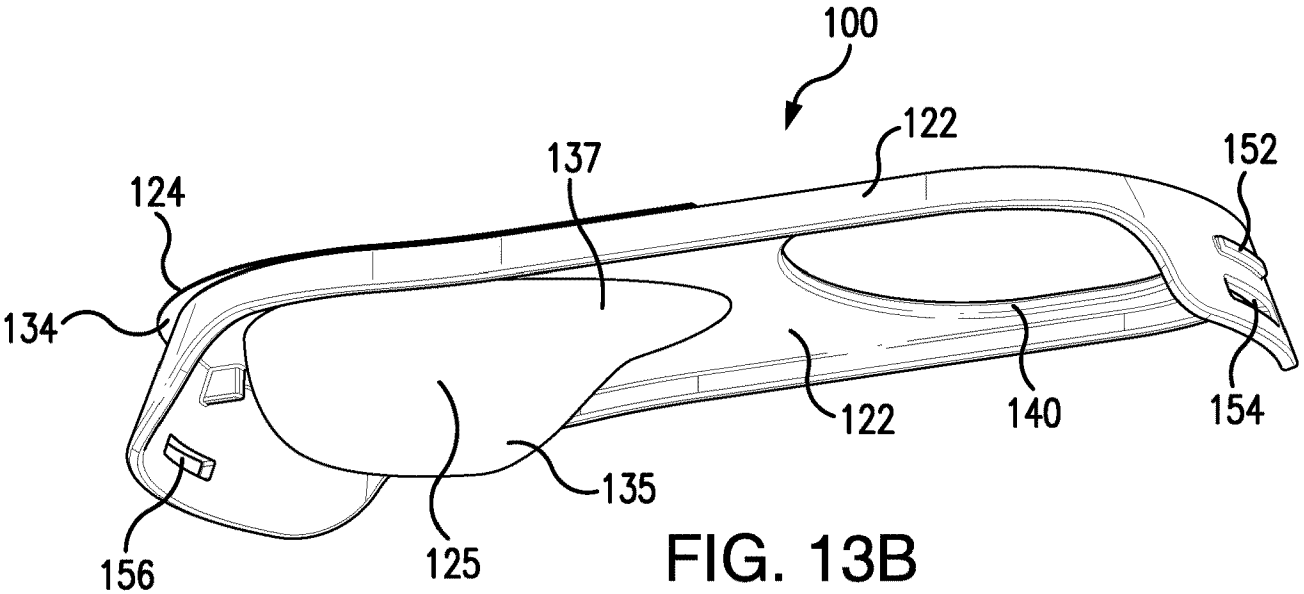
FIG. 13B is a back, right, bottom perspective view of the blister package shown in FIG. 13A.
Figure 13C:
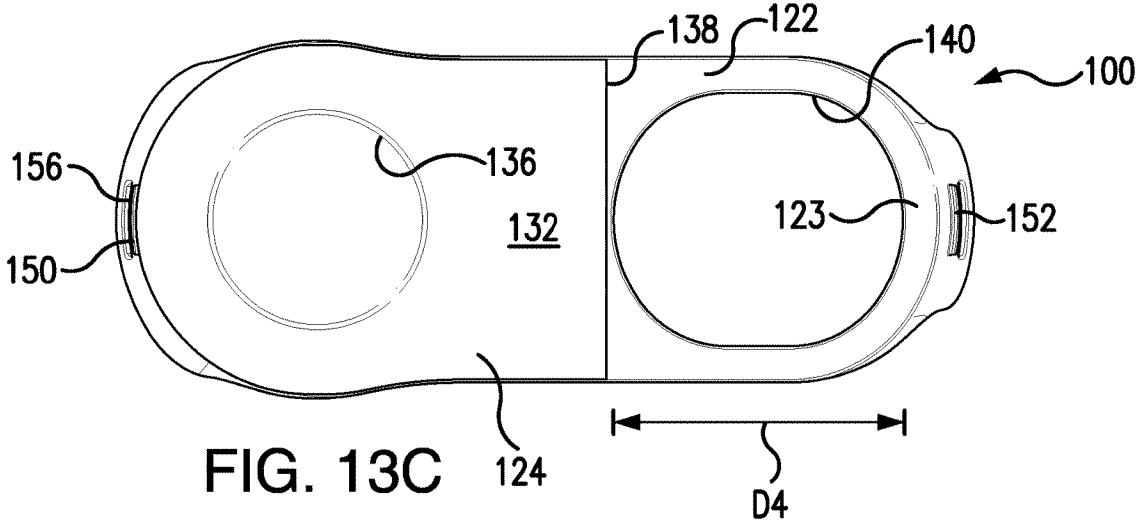
FIG. 13C is a top view of the blister package shown in FIGS. 13A and 13B.
Figure 13D:
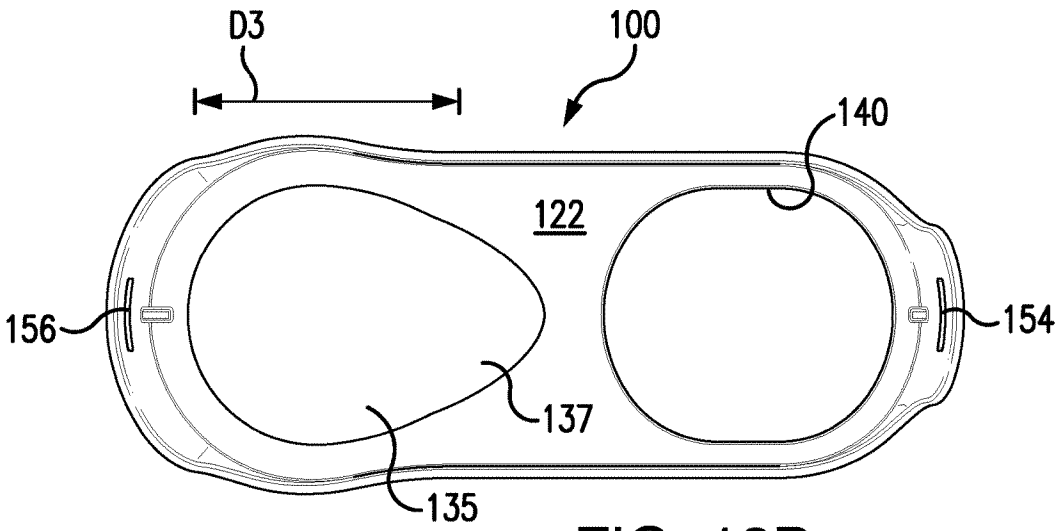
FIG. 13D is a bottom view of the blister package shown in FIGS. 13A-13C.
Figure 13E:
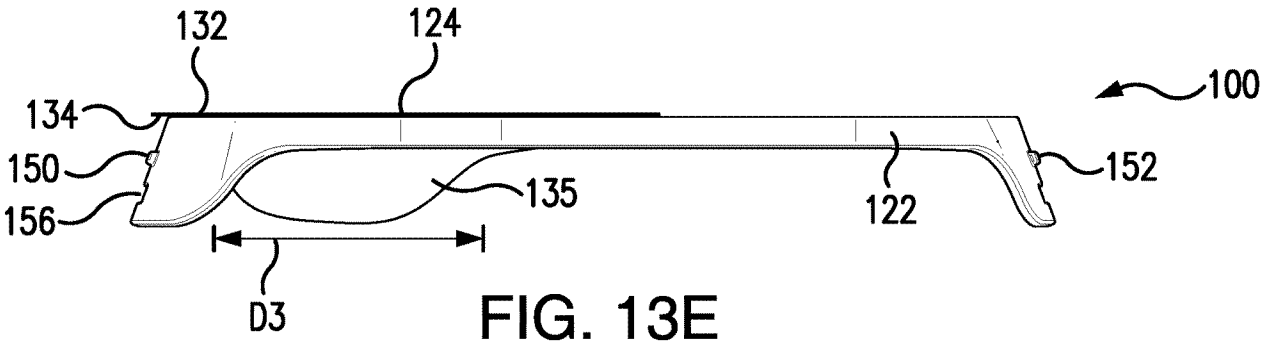
FIG. 13E is a right-side view of the blister package shown in FIGS. 13A-13D.
Figure 13F:
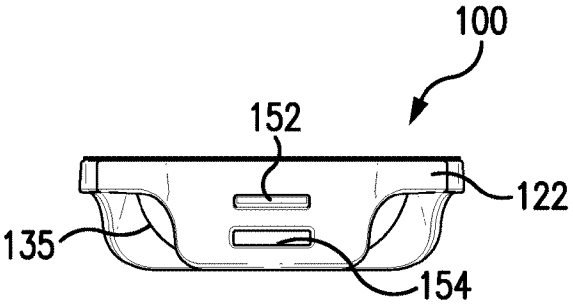
FIG. 13F is a rear, end view of the blister package shown in FIGS. 13A-13E.
Figure 13G:
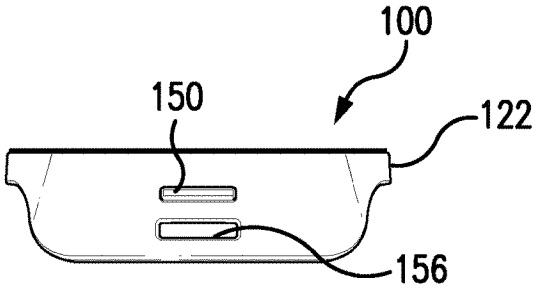
FIG. 13G is a front, end view of the blister package shown in FIGS. 13A-13F.

FIG. 13A is a front, right, top perspective view of a blister package 100 according to yet another embodiment of the present invention. FIG. 13B is a back, right, bottom perspective view of blister package 100. FIG. 13C is a top view of blister package 100. FIG. 13D is a bottom view of blister package 100. FIG. 13E is a right-side view of blister package 100. FIG. 13F is a rear, end view of blister package 100. FIG. 13G is a front, end view of blister package 100. Blister package 100 comprises a body 122 and a seal 124. Body 122 defines a handle 123 and a bowl 125 having an inner sidewall that is not shown in FIGS. 1A-1G as it is sealed by seal 124. Seal 124 is attached to a top surface 127 of body 122 and seals bowl 125. Seal 124 is of a folded construction such that a top flap 132, of which, can be pulled-up to form a pull-tab and the bottom portion 134, of which, seals bowl 125. Top flap 132 and bottom portion 134 can intersect at a fold line 138 as seen in FIGS. 13A and 13C. An outer sidewall 135 of bowl 125 can be seen at least in FIGS. 13A, 13B, 13D, and 13E. Seal 124 includes a depression 136 that fits into bowl 125 and minimizes the volume taken-up by bowl 125. Depression 136 can be used to reduce the amount of contact lens solution needed to preserve a contact lens within bowl 125.

Blister package 100 is shown in an unopened state in FIGS. 13A-13G. As can be seen in FIGS. 13B and 13D, the outer sidewall of bowl 125 is oblong-shaped and somewhat oval. Bowl 125 includes a beach and the outer sidewall of bowl 125 where the beach is defined is shown as outer sidewall portion 137. Body 122 defines a through-hole 140 designed to accommodate outer sidewall 135 of bowl 125. Through-hole 140 is similarly oblong-shaped, particularly oval, as best seen in FIGS. 13C and 13D. The shapes of outer sidewall 135 and through-hole 140 are designed to complement each other so that the bowl of one blister package 100 can sit within the through-hole of an underlying blister package 100. As such, a plurality of blister packages 100 can be stacked together, alternately, and take-up very little height as a stack. Outer sidewall 135 of bowl 125 can have a deep well maximum dimension D3 at the outer sidewall that defines the bowl proper, without including the area defining the beach. Through-hole 140 can have a maximum dimension D4 that is at least as large as maximum dimension D3. Accordingly, through-hole 140 can accommodate the outside surface 135 of bowl 125 that defines the deep bowl portion of bowl 125, without the beach.

As also seen in FIGS. 13A-13G, at the front and rear ends of blister package 100 protruding nibs 150 and 152, respectively, are provided. When stacked together with other blister packages of the same design, nibs 150 and 152 engage slots 154 and 156, respectively, at opposite ends of an overlying blister package. As such, nib 150 of a first blister package 100 is configured to engage and be nestled in slot 154 of an overlying blister package and nib 152 of the first blister package is configured to engage and be nestled in slot 156 of the overlying blister package 100. The nibs and slots enable the blister packages of a stack to be secured together although easily separable.

Figure 14:
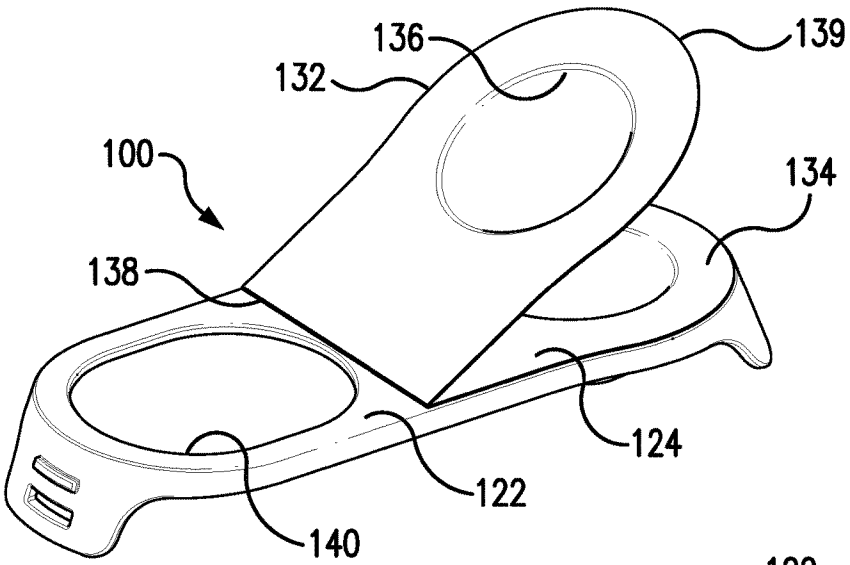
FIG. 14 is a rear, left, top perspective view of a blister package as shown in FIGS. 13A-13G wherein the top flap of the seal has been lifted away from the top surface of the blister package forming a pull-tab.

FIG. 14 is a rear, left, top perspective view of a blister package 100 as shown in FIGS. 13A-13G wherein top flap 136 of seal 124 has been lifted away from the blister package forming a pull-tab 139. Bottom portion 134 of seal 124 can be seen continuing to seal the bowl. Reference numbers that are the same in FIGS. 13A-13G, 14, and 15 denote the same respective features.

Figure 15:
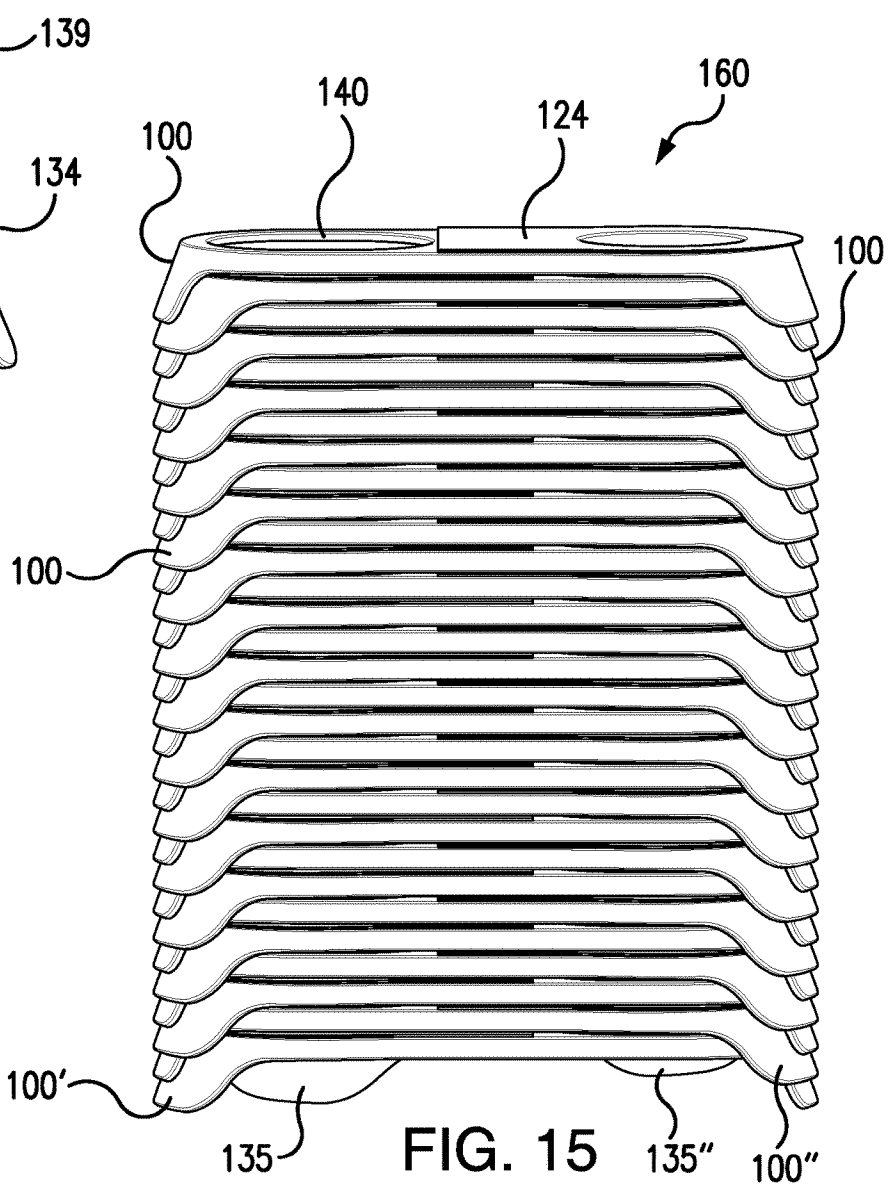
FIG. 15 is a side view of a double stack of 30 alternately arranged blister packages of the type shown in FIGS. 13A-13G and 14.

FIG. 15 is a side view of a double stack 160 of 30 alternatingly arranged blister packages 100 of the type shown in FIGS. 13A-13G and 14. An outer sidewall 135 of bottom blister package 100' of the stack can be seen. Also seen is outer sidewall 135" of blister package 100" that is second-from-the-bottom of stack 160. Outer sidewall 135" can be seen protruding through the through-hole (not shown) of bottom blister package 100'.

The present invention includes the following aspects/embodiments/features in any order and/or in any combination:

1. A blister package for a contact lens, the blister package comprising:

a body having a top surface and comprising a handle and a body dome connected to the handle;

a seal attached to the top surface of the body, the seal having a seal top surface and comprising a seal dome having an outer sidewall and an inner sidewall, the seal sealing a volume between the outer sidewall of the body dome and the inner sidewall of the seal dome, the seal dome intersecting the seal top surface at an intersection, the seal dome having a diameter or other maximum dimension at the intersection, the handle having a through-hole, and the through-hole having a through-hole diameter or other maximum dimension for at least partially accommodating the outer sidewall of the seal dome; and the outer sidewall of the seal dome defines a blister package dome.

2. The blister package of any preceding or following embodiment/feature/aspect, further comprising a contact lens having a concave surface positioned on the body dome.
3. The blister package of any preceding or following embodiment/feature/aspect, wherein the through-hole diameter or other maximum dimension is the same size as the diameter or other maximum dimension of the blister package dome at the intersection.
4. The blister package of any preceding or following embodiment/feature/aspect, wherein the diameter or other maximum dimension at the intersection forms a maximum dimension of the blister package dome, and the through-hole diameter or other maximum dimension is at least as large as the maximum dimension of the blister package dome.
5. The blister package of any preceding or following embodiment/feature/aspect, wherein the through-hole is a circular through-hole, the circular through-hole has a diameter, the blister package dome has a diameter at the intersection, and the diameter of the through-hole is large enough to at least partially accommodate the blister package dome.
6. The blister package of any preceding or following embodiment/feature/aspect, wherein the diameter of the through-hole is at least 50% of the diameter at the intersection.
7. The blister package of any preceding or following embodiment/feature/aspect, wherein the seal comprises a tab extending into the through-hole.
8. The blister package of any preceding or following embodiment/feature/aspect, further comprising a contact lens enclosed within the volume, and wherein the tab is marked with indicia pertaining to a prescription of the contact lens.
9. The blister package of any preceding or following embodiment/feature/aspect, wherein the body and the seal comprise foil material.
10. The blister package of any preceding or following embodiment/feature/aspect, wherein the body and the seal comprise foil material and the seal dome is reinforced with a plastic material.
11. The blister package of any preceding or following embodiment/feature/aspect, wherein the body comprises a plastic material and the seal comprises a plastic material.
12. A stack of blister packages, each blister package of the stack comprising a blister package of any preceding or following embodiment/feature/aspect, wherein the through-hole of a first of the blister packages is placed on, and at least partially around, the blister package dome of a second, adjacent, blister package of the blister packages of the stack.
13. The stack of blister packages of any preceding or following embodiment/feature/aspect, and a container, wherein each of the blister packages has an outer circumference, the outer circumferences all have the same profile, the container has an inner circumference having a profile, and the outer circumference profiles are complementary to the profile of the inner circumference.
14. The stack of blister packages of any preceding or following embodiment/feature/aspect, wherein adjacent blister packages of the stack are connected to one another along an edge of each such that the stack comprises a zig-zag configuration.
15. A blister package for a contact lens, the blister package comprising:

a body, the body comprising a handle and a bowl connected to the handle, the body having a top surface and a bottom surface, the bowl having a bowl outer surface that intersects with the bottom surface at an intersection, the intersection having a diameter or other maximum dimension, the handle having a through-hole, and the through-hole having a through-hole diameter or other maximum dimension for at least partially accommodating the bowl outer surface; and a seal connected to the body and sealing the bowl.

16. The blister package of any preceding or following embodiment/feature/aspect, further comprising a contact lens having a convex surface and positioned in the bowl.
17. The blister package of any preceding or following embodiment/feature/aspect, wherein the through-hole diameter or other maximum dimension is at least as large as the diameter or other maximum dimension of the intersection.
18. The blister package of any preceding or following embodiment/feature/aspect, wherein the seal comprises a foil material.
19. The blister package of any preceding or following embodiment/feature/aspect, wherein the handle extends from the body top surface and turns downwardly to a distal end.
20. The blister package of any preceding or following embodiment/feature/aspect, wherein the seal comprises a tab extending into the through-hole.
21. The blister package of any preceding or following embodiment/feature/aspect, wherein the seal comprises a double layer foil component, the double layer foil component comprises a sheet of material folded upon itself and defining a foil seal, a flap, and a fold, the foil seal and the seal flap intersecting at the fold, wherein the foil seal contacts the top surface of the body, forming the seal, the flap is configured to be pulled away from the foil seal to form a pull tab, and the pull tab is configured to be pulled so that the foil seal can be separated from the top surface and the bowl can be opened.
22. The blister packages of any preceding or following embodiment/feature/aspect, wherein the foil seal is adhered to the top surface of the body and the fold contacts the top surface between the bowl and a distal end of the handle.

23. A stack of blister packages, each blister package of the stack comprising a blister package of any preceding or following embodiment/feature/aspect, wherein the bowl of a first of the blister packages is placed in the through-hole of a second, adjacent, blister package of the blister packages.

24. The stack of blister packages of any preceding or following embodiment/feature/aspect, and a container, wherein each of the blister packages has an outer circumference, the outer circumferences all have the same profile, the container has an inner circumference having a profile, and the outer circumference profiles are complementary to the profile of the inner circumference.

25. The stack of blister packages of any preceding or following embodiment/feature/aspect, wherein adjacent blister packages of the stack are connected to one another along an edge of each such that the stack comprises a zig-zag configuration.

The present invention can include any combination of these various features or embodiments above and/or below as set-forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A blister package for a contact lens, the blister package comprising:

a body having a top surface and comprising a handle and a body dome connected to the handle, the body dome having a convex sidewall and an opposite concave sidewall; and a seal attached to the top surface of the body, the seal having a seal top surface and comprising a seal dome having an outer convex sidewall and an inner concave sidewall, the seal sealing a volume between the convex sidewall of the body dome and the inner concave sidewall of the seal dome, the seal dome intersecting the seal top surface at an intersection, the seal dome having a diameter or other maximum dimension at the intersection, the handle having a body through-hole, the seal having a seal through-hole aligned with and a same size as the body through-hole, and the body through-hole and the seal through-hole having a through-hole diameter or other maximum dimension for at least partially accommodating the outer convex sidewall of the seal dome to permit stacking of a plurality of blister packages, wherein the outer convex sidewall of the seal dome defines a blister package dome.

2. The blister package of claim 1, further comprising a contact lens having a concave surface positioned on the convex sidewall of the body dome.

3. The blister package of claim 1, wherein the through-hole diameter or other maximum dimension is the same size as the diameter or other maximum dimension of the blister package dome at the intersection.

4. The blister package of claim 1, wherein the diameter or other maximum dimension at the intersection forms a maximum dimension of the blister package dome, and the through-hole diameter or other maximum dimension is at least as large as the maximum dimension of the blister package dome.

5. The blister package of claim 1, wherein the body through-hole and the seal through-hole are circular through-holes, the circular through-holes having a diameter, the blister package dome has a diameter at the intersection, and the diameter of the circular through-holes is large enough to at least partially accommodate the blister package dome.

6. The blister package of claim 5, wherein the diameter of the circular through-holes is at least 50% of the diameter at the intersection.

7. The blister package of claim 1, wherein the seal comprises a tab extending into the seal through-hole.

8. The blister package of claim 7, further comprising a contact lens enclosed within the volume, and wherein the tab is marked with indicia pertaining to a prescription of the contact lens.

9. The blister package of claim 1, wherein the seal dome is reinforced with a layer of plastic material.

10. The blister package of claim 1, wherein the body comprises a plastic material and the seal comprises a plastic material.

11. A stack of blister packages, each blister package of the stack comprising a blister package of claim 1, wherein the body through-hole and the seal through-hole of a first of the blister packages is placed on, and at least partially around, the blister package dome of a second, adjacent, blister package of the blister packages of the stack.

12. The stack of blister packages of claim 11, and a container, wherein each of the blister packages has an outer circumference, the outer circumferences all have the same profile, the container has an inner circumference having a profile, and the outer circumference profiles are complementary to the profile of the inner circumference.

13. The stack of blister packages of claim 11, wherein adjacent blister packages of the stack are connected to one another along an edge of each such that the stack comprises a zig-zag configuration.

14. The blister package of claim 1, wherein the body comprises a foil material and the seal comprises a foil material.

15. The blister package of claim 1, wherein the body and the seal comprise foil material and the body dome is reinforced with a double layer of foil.

* * * * *